US006727792B2

(12) United States Patent
Amada et al.

(10) Patent No.: US 6,727,792 B2
(45) Date of Patent: Apr. 27, 2004

(54) METHOD OF MANUFACTURING WIRE WOUND ELECTRONIC COMPONENT

(75) Inventors: Yoshihiro Amada, Tokyo (JP); Hideo Aoba, Tokyo (JP); Kazuhiko Otsuka, Tokyo (JP); Nobuhiro Umeyama, Tokyo (JP); Katsuo Koizumi, Tokyo (JP); Nobuo Mamada, Tokyo (JP); Iwao Fujikawa, Tokyo (JP); Nobuyasu Shiba, Tokyo (JP); Takayuki Uehara, Tokyo (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 10/229,074

(22) Filed: Aug. 28, 2002

(65) Prior Publication Data

US 2002/0190832 A1 Dec. 19, 2002

Related U.S. Application Data

(62) Division of application No. 09/664,720, filed on Sep. 19, 2000, now Pat. No. 6,449,830, which is a division of application No. 08/967,786, filed on Nov. 10, 1997, now Pat. No. 6,144,280.

(30) Foreign Application Priority Data

| | | |
|---|---|---|
| Nov. 29, 1996 | (JP) | 8-334973 |
| Nov. 30, 1996 | (JP) | 8-334825 |
| Dec. 14, 1996 | (JP) | 8-352817 |

(51) Int. Cl.[7] ..... H01F 27/29

(52) U.S. Cl. ..... 336/192; 336/200; 336/83

(58) Field of Search ..... 336/65, 83, 96, 336/192, 198, 200, 232, 205–208; 29/602.1, 605, 608, 621

(56) References Cited

U.S. PATENT DOCUMENTS

| | | | | |
|---|---|---|---|---|
| 3,585,553 A | | 6/1971 | Muckelroy et al. | |
| 4,316,923 A | | 2/1982 | Monforte et al. | |
| 4,696,100 A | | 9/1987 | Yamamoto et al. | |
| 4,704,592 A | * | 11/1987 | Marth et al. | 336/83 |
| 4,755,784 A | * | 7/1988 | Taoka et al. | 336/96 |
| 4,810,983 A | * | 3/1989 | Okubo | 336/90 |

FOREIGN PATENT DOCUMENTS

| | | | |
|---|---|---|---|
| JP | 51-115547 | | 9/1975 |
| JP | 56-110612 | | 8/1981 |
| JP | 53-126833 | | 9/1981 |
| JP | 57-93115 | | 6/1982 |
| JP | 57-73916 | | 8/1982 |
| JP | 60-109313 | | 7/1985 |
| JP | 61-144616 | | 9/1986 |
| JP | 61-201312 | | 12/1986 |
| JP | 62-190322 | | 12/1987 |
| JP | 62-286211 | | 12/1987 |
| JP | 2-91371 | | 7/1990 |
| JP | 4-364009 | * | 6/1991 |

(List continued on next page.)

*Primary Examiner*—Tuyen T. Nguyen
(74) *Attorney, Agent, or Firm*—McDermott, Will & Emery

(57) ABSTRACT

A wire wound electronic component of the present invention includes a bobbin having a core 1*a* having a substantially circular cross-section and rectangular flanges 1*b* formed at both ends of the core. A groove 2 is formed in each side of each flange 1*b*. A conductive film or external electrode 3 is formed on each flange 1*b*. A coil or wire 4 is wound round the core 1*a* and has a conductor protruding from opposite stripped ends thereof. The opposite ends 5 of the conductor are respectively received in the grooves 2 of the flanges 1*b* and connected to the conductive films 3. A coating or armor 6 is formed on the coil 4 and has a flat surface 6*a*. The coating 6 has a rectangular configuration complementary to the configuration of the flanges 1*b*.

9 Claims, 27 Drawing Sheets

FOREIGN PATENT DOCUMENTS

| | | |
|---|---|---|
| JP | 4-364009 | 12/1992 |
| JP | 5-77909 | 10/1993 |
| JP | 7-37720 | 2/1995 |
| JP | 7-192931 | 7/1995 |
| JP | 7-220948 | 8/1995 |
| JP | 8-264343 | 10/1996 |
| JP | 8-264384 | 10/1996 |
| JP | 8-298359 | 11/1996 |

* cited by examiner

METHOD OF MANUFACTURING WIRE WOUND ELECTRONIC COMPONENT

This application is a divisional of application Ser. No. 09/664,720 filed Sep. 19, 2000 now U.S. Pat. No. 6,449,830, which is a divisional of application Ser. No. 08/967,786, filed Nov. 10, 1997 now U.S. Pat. No. 6,144,280.

FIELD OF THE ART

The present invention relates to an inductor, transformer, choke coil or similar wire wound electronic component.

BACKGROUND ART

A wire wound electronic component has been put to practical use in various forms, and various improvements have been made in the past. Japanese Utility Model Laid-Open Publication No. 51-115547, for example, teaches a fixed inductance device having a bobbin made up of a core and flanges, conductive layers formed on the circumferential surfaces of the flanges, and a coil wound round the core. A conductor protruding from opposite stripped ends of the coil is connected to the conductive layers and to conductive portions provided on a printed circuit board. Japanese Utility Model Laid-Open Publication No. 56-110612 discloses an inductance device having flanges formed with grooves, and a coil whose conductor is received in the grooves at both ends thereof.

Japanese Patent Laid-Open Publication No. 57-73916 proposes a miniature inductor including a core, flanges formed at both ends of the core, conductive layers respectively formed on the flanges, and a coil wound round the center of the core. In this inductor, electrodes are formed after the assembly has been sealed with a resin. Further, Japanese Utility Mode Laid-Open Publication No. 61-144616 discloses a chip coil in which a conductor protruding from opposite stripped ends of a coil is drawn out via grooves formed in rectangular flanges, and electrodes are also formed on the sides of the flanges.

As stated above, a wire wound electronic component has a coil wound round a core and has a conductor protruding from the coil bonded to the electrodes of flanges. Such a wire wound electronic component may be produced by a method shown in FIG. 27. As shown in FIG. 27, (A), in a section, a bobbin having a core 900 and flanges 902 formed at both ends of the bobbin 900 is prepared. Then, as shown in FIG. 27, (B), electrodes 904 are respectively formed on the sides and end faces of the flanges 902 by dipping or similar technology. Subsequently, as shown in FIG. 27, (C), a coil 906 is wound round the core 900 and has its outgoing conductor 908 connected to the electrodes 904 by, e.g., heat pressure welding.

As shown in FIG. 27, (D), a resin or a paint is applied to the core portion, which was wound the coil 906, in order to form a coating or armor 910. Then, as shown in FIG. 27, (E), a plating 912 of, e.g., Ni is formed on each electrode 904. Finally, as shown in FIG. 27, (F), the assembly is entirely trimmed into a column having a rectangular cross-section.

In parallel with advances in the small size, light weight configuration of an electronic apparatus, there is an increasing demand for small size, light weight wire wound electronic components. In addition, improvements in mounting efficiency and productivity are essential from the cost saving standpoint. It is an object of the present invention to reduce the size and weight of a wire wound type electronic component without degrading its performance or reliability. It is another object of the present invention to improve the mounting efficiency and productivity of a wire wound electronic component.

DISCLOSURE OF THE INVENTION

A wire wound electronic component of the present invention is characterized by comprising a bobbin including a core and flanges formed at both ends of the core, electrodes respectively formed on the flanges, a coil wound round the core and having stripped portions thereof connected to the electrodes, and a coating formed on the coil and having a flat surface.

Also, a method of producing a wire wound electronic component of the present invention comprises the steps of machining a block for forming a bobbin having a core and flanges, forming electrodes on the flanges, winding a coil round the core and connecting stripped portions of the coil to the electrodes, and providing a coating having a flat surface on the coil.

Many other features, advantages and additional objects of the present invention will become manifest to those versed in the art upon making reference to the detailed description which follows and the accompanying sheet of drawings.

BEST MODE OF PRACTICING THE INVENTION

Figure 1A:
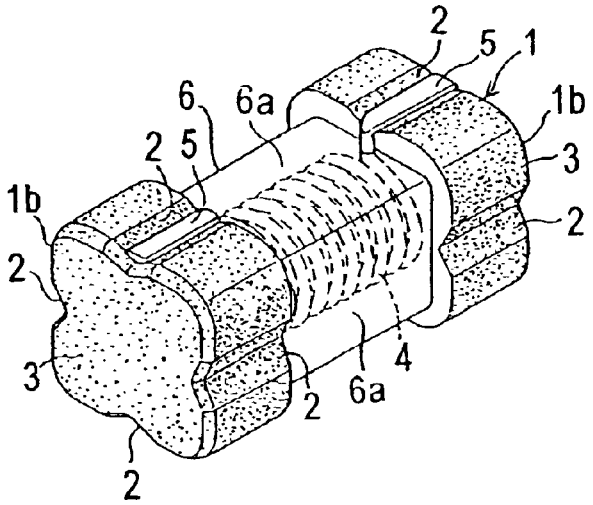
FIG. 1 shows a specific basic configuration of a chip inductor embodying the present invention in a perspective view and a section, and shows a modification of the embodiment in a side elevation.
Figure 1B:
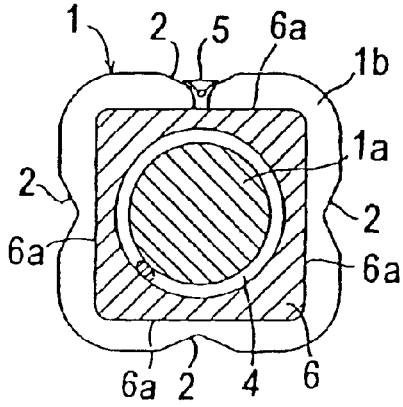
Figure 1C:
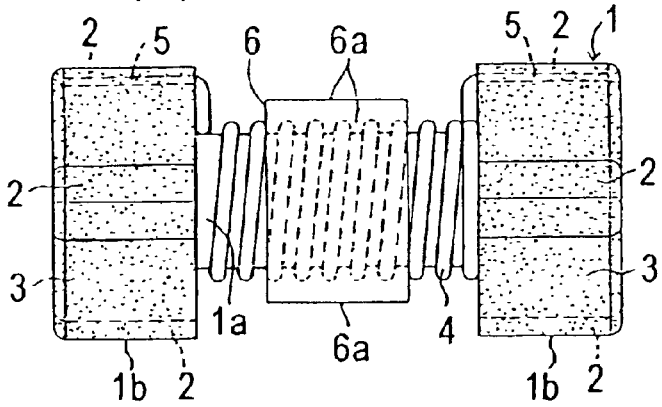
Figure 1D:
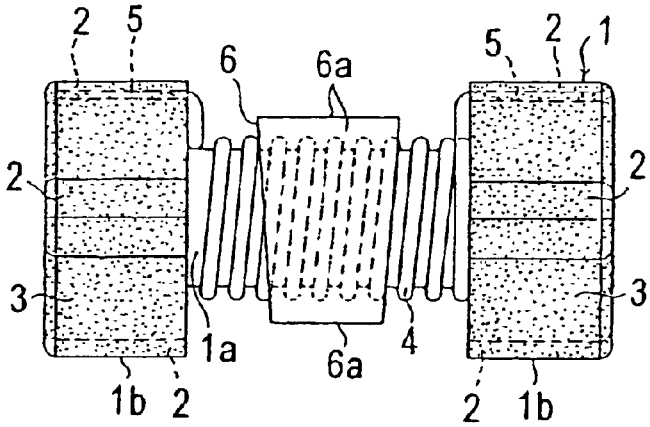
Figure 2A:
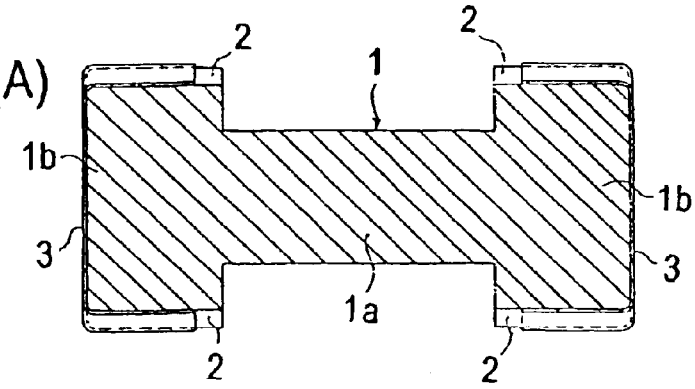
FIG. 2 shows in a section a bobbin having conductive films or external electrodes different from conductive films of FIG. 1, and shows in a plan view a coil connection structure different from a structure shown in FIG. 1.
Figure 2B:
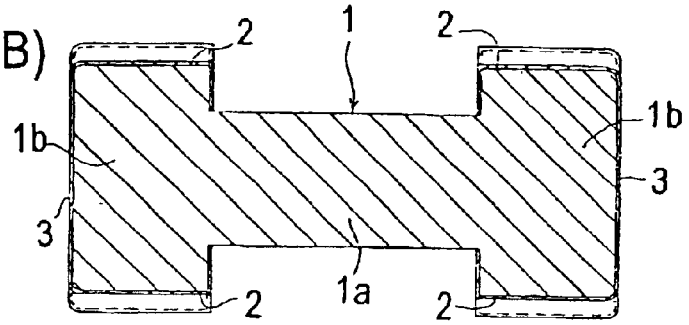
Figure 2C:
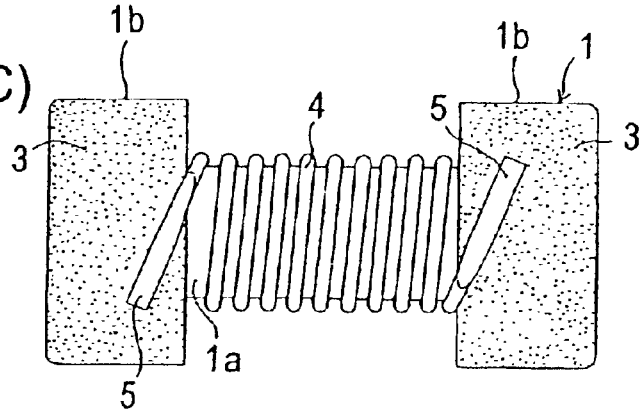
Figure 2D:
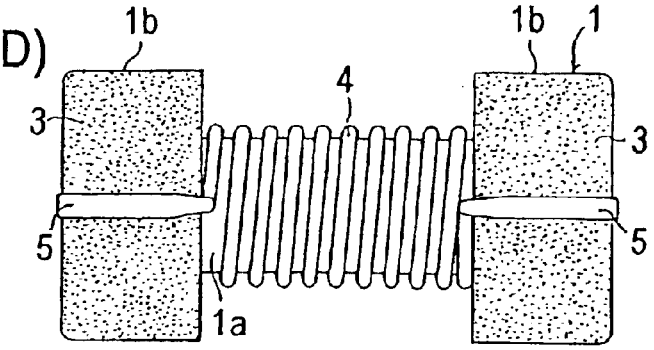

While the present invention is practicable in various modes, an adequate number of embodiments thereof will be shown and described in detail.

Referring to FIGS. 1, (A) and (B), a specific configuration of a chip inductor is shown and includes a magnetic bobbin 1. The bobbin 1 has a core 1*a* having a circular cross-section and rectangular flanges 1*b* formed at both ends of the core 1*a*. The flanges 1*b* are sized 0.8 mm square by way of example and formed of ferrite or similar material. A groove 2 having a generally V-shaped cross-section and, e.g., 0.06 mm depth is formed in each side of each flange 1*b*. A conductive film or external electrode 3 is formed on the four sides and end face of each flange 1*b*. The conductive film 3 is made up of an underlying layer mainly consisting of silver, silver-platinum alloy or copper and an overlying layer of nickel or lead-tin alloy.

A coil, i.e., a sheathed wire 4 is wound round the core 1*a* of the bobbin 1 and formed of polyurethane, polyamide-imide or similar insulating material. The coil 4 has a diameter of, e.g., 20 $\mu$m to 120 $\mu$m. Opposite ends 5 of the coil 4, i.e., opposite ends of a conductor protruding from the stripped ends of the coil 4 are respectively received in the V-shaped grooves 2 of the flanges 1*b* and bonded to the conductive films 3 by welding, heat pressure welding or ultrasonic oscillation welding. In the case of heat pressure welding, a heated head is pressed against each end 5 of the coil 4 in order to bond it to the conductive film 3; the end 5 is deformed to be flat. In the case of ultrasonic oscillation welding, the sheath of the coil 4 is removed by the oscillation of a head, and a cleaned copper wire and the conductive film 3 are bonded together by heat applied by a heating head.

Because the core 1*a* has a substantially circular cross-section, the coil 4 can be wound round the core 1*a* in close contact with the surface of the core 1*a*. This reduces the scattering of inductance and protects the sheath of the wire from damage, compared to a bobbin having a rectangular core. A coating or armor portion 6 is formed on the entire circumference of the coil 4 and formed of an epoxy resin (with or without a filler) or similar insulator. To form the coating 6, use may be made of potting. The surface of the coating 6 is flattened such that it is positioned inward of the peripheries of the flanges 1*b* while its portions corresponding to the corners of the flanges 1*b* protrude to the outside of the incircles of the flanges 1*b*. Specifically, as shown in FIG. 1, (B), the coating 6 has a rectangular cross-section complementary to the configuration of each flange 1*b* and has its surface positioned inward of the flange 1*b*.

When the above inductor is adapted for a high frequency application, the magnetic bobbin 1 may be replaced with a bobbin formed of alumina or similar insulator. In the illustrative embodiment, the coating 6 is provided on the entire periphery of the coil 6. Alternatively, as shown in FIG. 1, (C) or (D), the coating 6 may be formed only on the intermediate portion of the coil 4 with or without a constant width.

The chip inductor can be readily transferred to a position above a printed circuit board only if a suction nozzle included in an automatic mounting machine is applied to the surface, labeled 6*a*, of the coating 6 so as to suck it. Subsequently, the conductive films 3 of the flanges 1*b* are soldered to a conductive pattern formed on the circuit board. With this configuration, it is not necessary to consider the mounting surface of the chip inductor when the inductor is mounted to the printed circuit board. In addition, because the flanges 1*b* of the bobbin 1 are rectangular, the chip inductor is prevented from rolling.

The dipping width of each flange 1*b* of the bobbin 1 is controllable in order to provide the conductive film 3 with a desired configuration. For example, as shown in FIG. 2, (A), the film 3 may be formed on each side of the flange 1*b* over only a part of the width of the side. Alternatively, as shown in FIG. 2, (B), the film 3 may extend even to the inner surface of the flange 1*b*.

The grooves 2 formed in the flanges 1*b* for receiving the ends 5 of the coil 4 are not essential. As shown in FIG. 2, (C) or (D), the ends 5 of the coil 4 may be inclined with respect to the thicknesswise direction of the flanges 2*b* or may even be bent along the contour of the flanges 1*b* when they are connected to the conductive films 3. Again, the ends 5 of the coil 4 are bonded to the films 3 in a flat configuration by welding, heat pressure welding or ultrasonic oscillation welding.

Figure 3A:
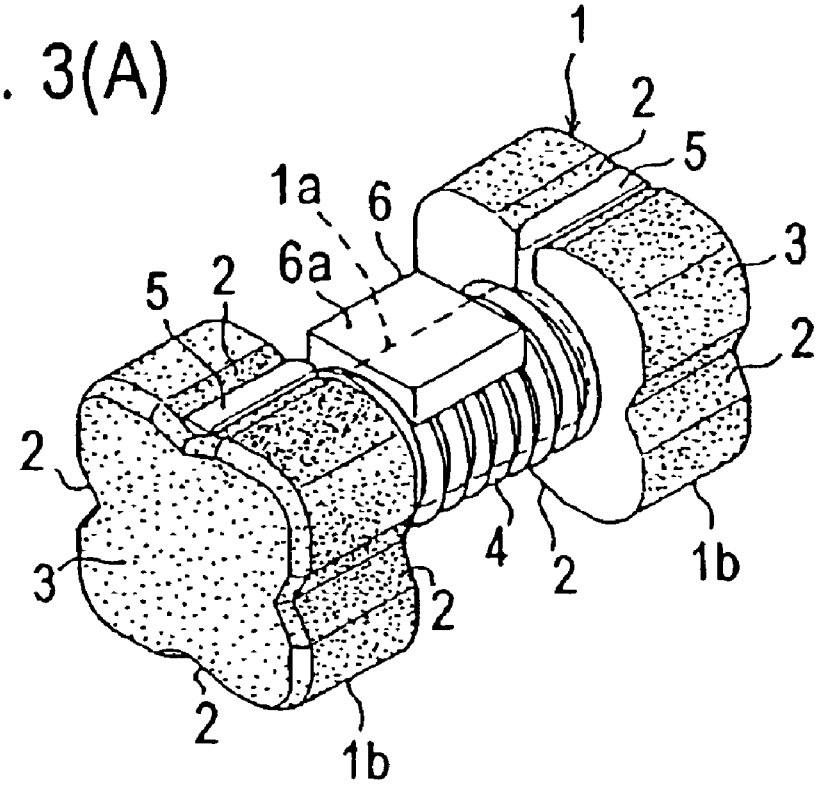
FIG. 3 shows another specific configuration of the chip inductor in a perspective view and a section.
Figure 3B:
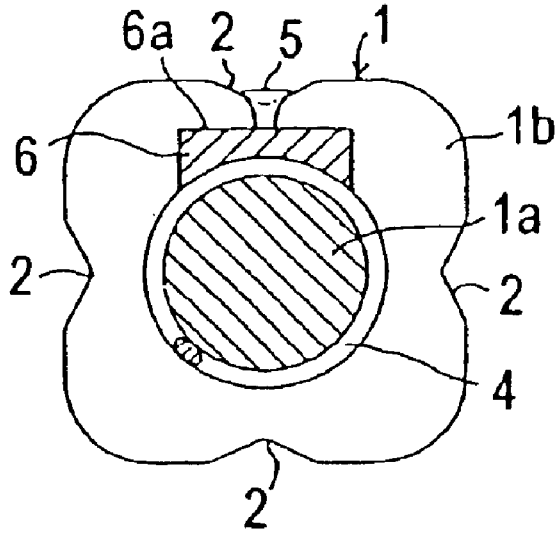
Figure 4A:
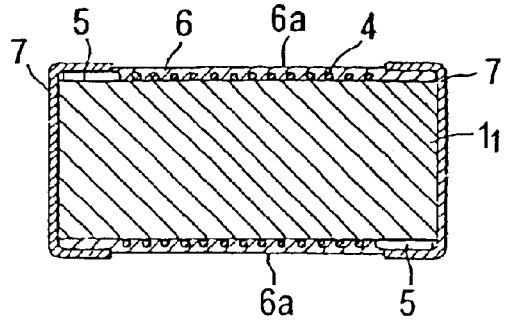
FIG. 4 shows other specific configurations of the chip inductor in sections.
Figure 4B:
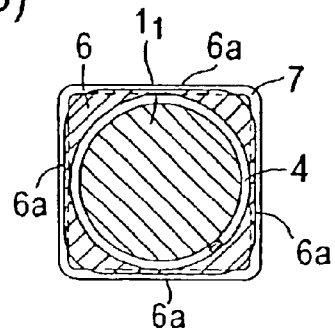
Figure 4C:
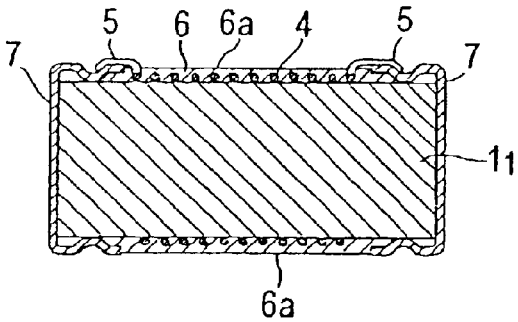
Figure 4D:
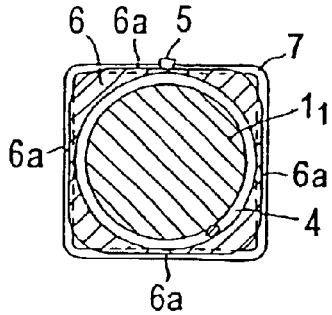
Figure 5A:
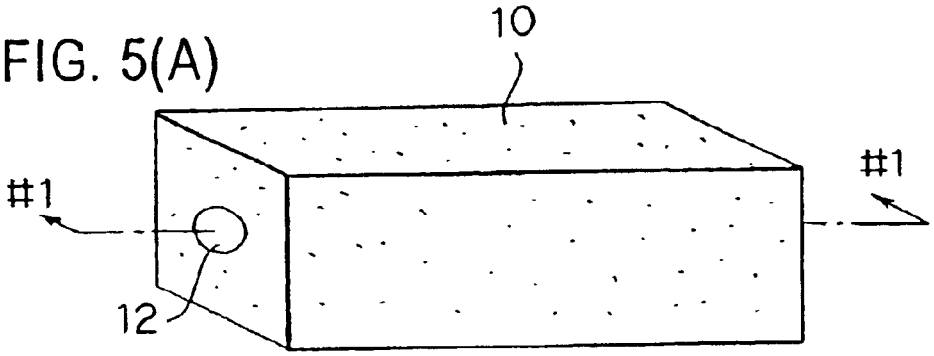
FIG. 5 shows in a perspective view and sections a major part of a method of producing a bobbin in accordance with the present invention.
Figure 5B:
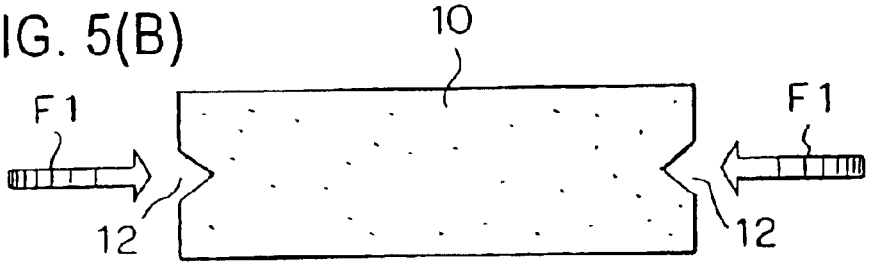
Figure 5C:
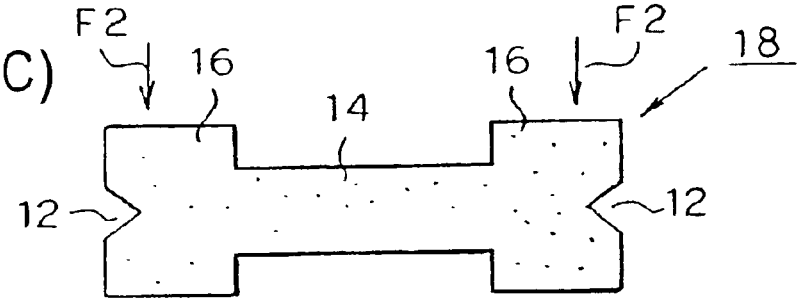
Figure 5D:
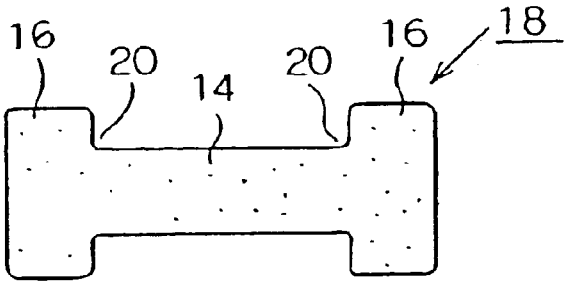
Figure 6D:
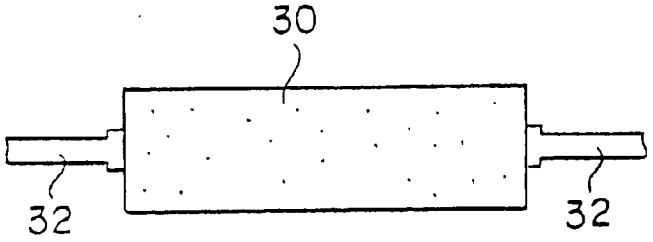
FIG. 6 shows in sections other specific procedures for producing the bobbin and particular to the present invention.
Figure 6E:
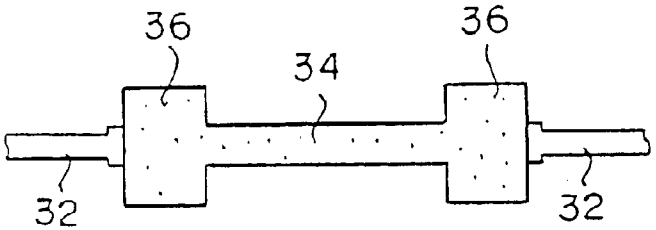
Figure 6A:
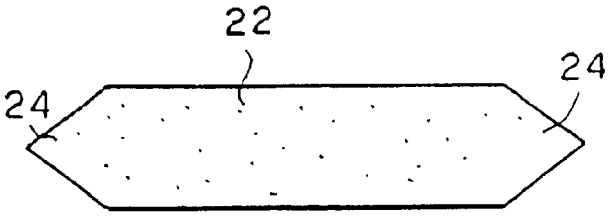
Figure 6B:
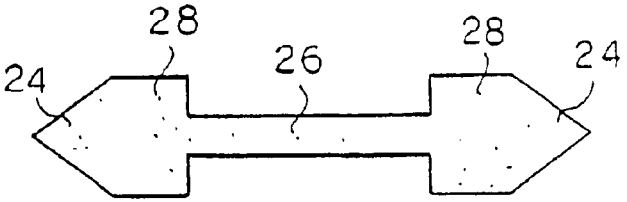
Figure 6C:
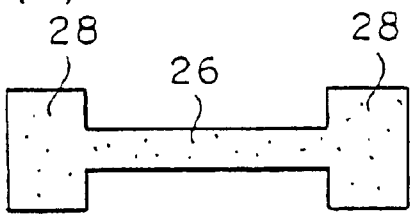
Figure 7A:
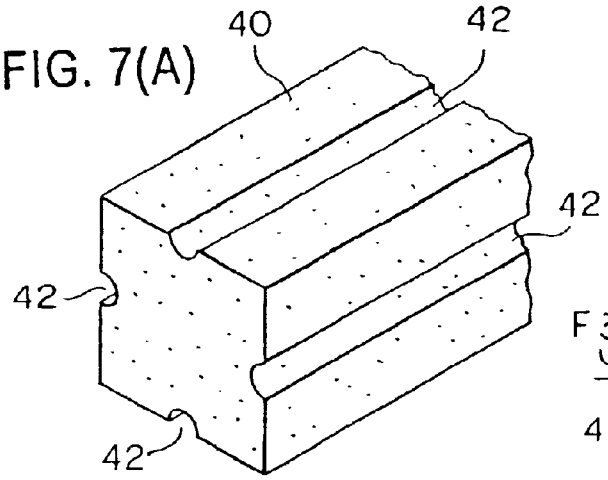
FIG. 7 shows other specific procedures available with the present invention in perspective views, an end view, and a side elevation.
Figure 7B:
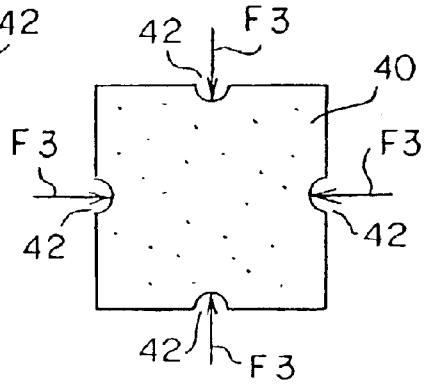
Figure 7C:
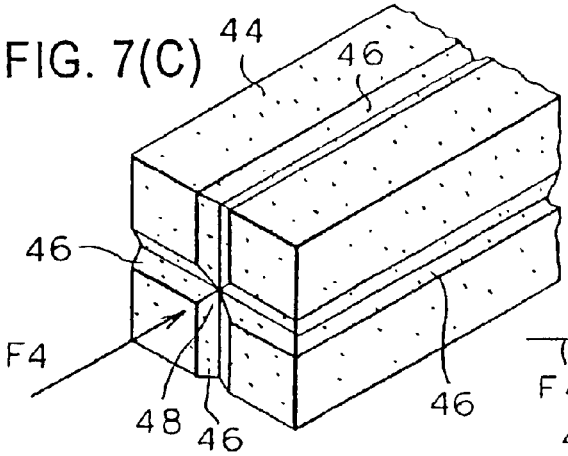
Figure 7D:
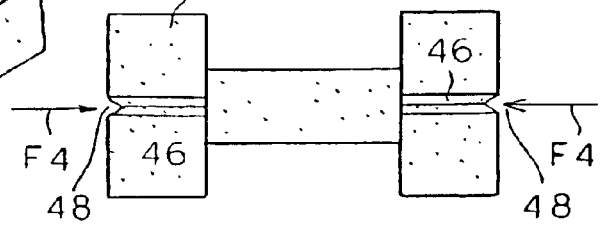
Figure 8A:
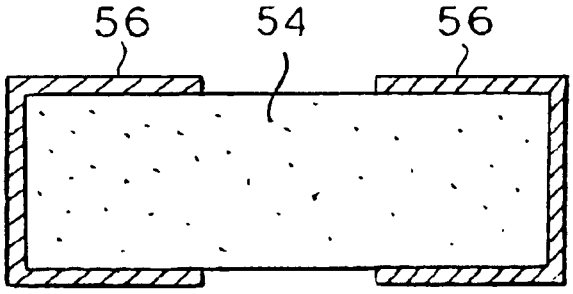
FIG. 8 show in sections other specific procedures for producing the bobbin and electrodes available with the present invention.
Figure 8B:
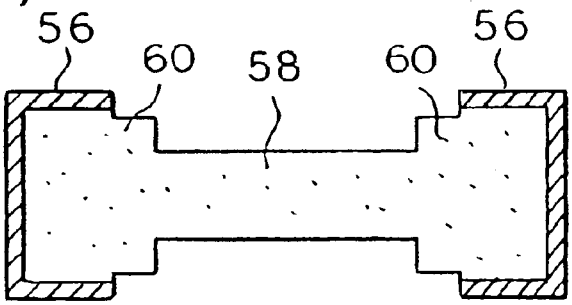
Figure 8C:
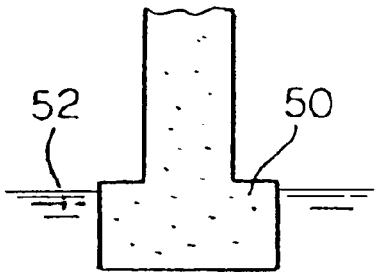
Figure 8D:
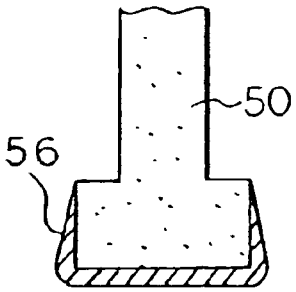
Figure 8E:
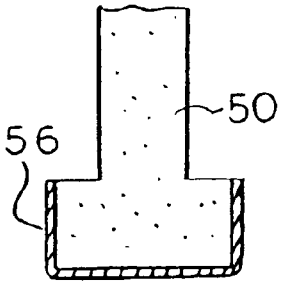

Another specific configuration of the chip inductor is shown in FIGS. 3, (A) and (B). As shown, the coating 6 is formed only on the part of the coil 4 corresponding to one of four sides of the flanges 1*b*. The surface 6*a* of the coating 6 is flat and positioned inward of the contour of the flanges 1*b*. As for the rest of the configuration, this chip inductor is identical with the chip inductor shown in FIGS. 1, (A)–(D). If desired, the coating 6 may be provided on the portion or portions of the coil 4 corresponding to one or two of the other sides of the flanges 1*b*.

While the flanges 1*b* of the inductor shown in FIG. 1, (A)–(D), is formed with the grooves 2 in all of its sides, the number of such grooves is open to choice. When each flange 1*b* is formed with the grooves 2 in all of its sides, the end 5 of the coil 4 can be received in any one of the four grooves 4 for setting up a desired inductance.

Still another specific configuration of the chip inductor is shown in FIGS. 4, (A) and (B). As shown, the inductor has a bobbin 11 formed of a magnetic material or an insulating material and also provided with a generally circular cross-section. A coil or sheathed wire 4 is wound round the bobbin 11. Conductive caps or external electrodes 7 each having a rectangular configuration are respectively fitted on opposite ends of the bobbin 11 in pressing contact wit the ends 5 of the coil 4. The coating 6 formed of resin, for example, is formed on the entire circumference of the coil 4. The coating 6 has a rectangular cross-section complementary to that of the caps 7. The flat surface 6*a* of the coating 6 is positioned inward of the caps 7, as in the embodiment shown in FIG. 1, (A)–(D).

A modification of the embodiment shown in FIGS. 4, (A) and (B), is shown in FIGS. 4, (C) and (D). As shown, after the rectangular conductive caps 7 have been fitted on opposite ends of the cylindrical bobbin 11, the ends 5 of the coil 4 wound round the bobbin 11 are bonded to the outer peripheries of the caps 7 by the previously mentioned technology. As for the rest of the configuration, the modification is identical with the embodiment of FIGS. 4, (A) and (B).

In FIGS. 4, (A)~(D), the coating 6 may be formed only in the intermediate portion of the coil 4, as shown in FIG. 1, (C) and (D), or may be provided only in the portion of the coil 4 corresponding to at least one of four sides of each cap 7, as shown in FIGS. 3, (A) and (B).

In the foregoing embodiments, the surface of the coating 6 should only be flat enough to be sucked by the suction nozzle of an automatic mounting machine. Specifically, the flatness may only be of such a degree that the coating 6 has a cross-section not concentric with the core 1*a* and reduces the irregularities ascribable to the turns of the coil 4 in the axial direction of the core 1*a*. While the coating 6 has been shown and described as being positioned inward of the peripheries of the flanges 1*b* or those of the caps 7, the former may be made flush with the latter or may even be positioned outside of the peripheries of the latter for mounting reasons. For the coating 6, use may be made of an epoxy resin or similar resin containing, e.g., ferrite powder or red iron oxide powder. This kind of material increases inductance and thereby allows the number of turns of the coil 4 to be reduced while implementing magnetic shield. The flanges 1*b* may each be provided with a polygonal configuration with or without rounded corners, if desired.

FIG. 5 shows another method of producing a bobbin embodying the present invention. In FIG. 5, (B) is a section along line #1—#1 shown in (A). As shown, a block 10 forming a bobbin has a rectangular cross-section. A recess 12 is formed in each of opposite end faces of the block 10 for a centering purpose. While the block 10 is rotated by being centered at its recesses 12, as indicated by arrows F1 shown in FIG. 5, (B), the intermediate portion of the block 10 is shaved. As a result, as shown in FIG. 5, (C), a bobbin 18 having a cylindrical core 14 and rectangular flanges 16 formed at both ends of the core 14 is produced. If necessary, the corners of the bobbin 18 may be rounded, as shown in FIG. 5, (D).

Further, portions 20 where the core 14 and flanges 16 adjoin each other may be provided with a curvature in order to enhance the rigid connection of the core 14 and flanges 16. The end portions of the flanges 16 formed with the recesses 12 may be left as they are, or may be cut away at a position indicated by arrows F2 in FIG. 5, (C), and then rounded, as shown in FIG. 5, (D).

FIG. 6, (A), shows another specific block 22 for forming a bobbin. As shown, the block 22 has projections or tapered ends 24 and is shaved by being centered at the tapered ends 24. FIG. 6, (B), shows the resulting bobbin having a core 24 and flanges 28. As shown in FIG. 6, (C), the projections 24 may be cut away, if necessary. FIG. 6, (D), shows another specific block 30 for forming a bobbin. As shown, leads 32 are bonded to opposite ends of the block 30. The block 30 is rotated with the leads 32 serving as the center. As a result, the block 30 is formed with a core 34 and flanges 34, as shown in FIG. 6, (E). The leads 32 may be left as they are or may be cut away like the recessed ends 12 or the projecting ends 24.

FIG. 7, (A) shows another specific block 40 for forming a bobbin. As shown, the block 40 has a rectangular cross-section and is formed with grooves 42 in its four sides. As shown in FIG. 7, (B), the block 40 is machined to form a core and flanges in the previously stated manner while being chucked at its grooves 42, as indicated by arrows F3. FIG. 7, (C), shows another specific block 44 formed with grooves 46 having a V-shaped cross-section in its sides and ends. The grooves 46 intersect each other at the end faces of the block 44. As indicated by arrows F4 shown in FIG. 7, (D), the block 44 is formed with a core and flanges while being chucked at its points 48 where the grooves 46 intersect each other. FIG. 7, (D), shows the resulting bobbin.

As stated above, the block shown in any one of FIGS. 5–7 can be accurately centered and therefore accurately machined. This allows electrodes to be efficiently formed and allows a coil to be efficiently wound later. When a flange is to be formed at only one end of the bobbin, one of the recesses or projections will be formed on the flange while the other recess or projection will be formed on the core.

FIG. 8 shows a method of forming electrodes on flanges. As shown in FIG. 8, (C), specifically, a flange 50 is formed by, e.g., being dipped in a paste 52 which includes silver liquid or similar liquid as the main components. With this method, however, it is impossible to form an electrode with accuracy because the depth to which the flange 50 is dipped is not stable.

In light of the above, in this embodiment, electrodes 56 are formed on a block 54 by dipping or similar method beforehand. The entire block 54 may be covered with a conductive film, if desired. Then, the block 54 is machined to form a core 58 and flanges 60, as in the previous embodiments. At the same time, the electrodes 56 are partly shaved off, as shown in FIG. 8, (B). This not only allows the electrodes 56 to be accurately formed, but also allows L(inductance) and Q(quality factor) to be accurately adjusted.

As shown in FIG. 8, (E), when the paste 52 has a low viscosity, the electrode 56 is formed along the surface of the flange 50 in a relatively flat configuration. As shown in FIG. 8, (D), when the paste 52 has a high viscosity, the electrode 56 bulges out and has a desirably great thickness at the corners of the flange 60. Therefore, the paste 52 should preferably have a high viscosity. If desired, a dipping liquid having a low viscosity and a dipping liquid having a high viscosity may be applied one after the other. For example the liquid with a low viscosity and the liquid with a high viscosity may be sequentially applied in this order.

Figure 9A:
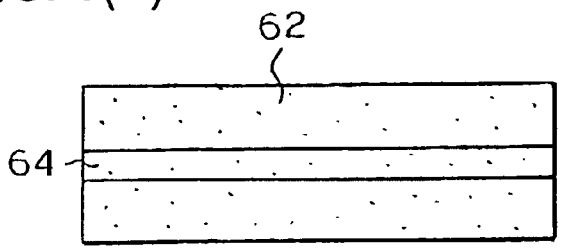
FIG. 9 shows another specific procedure for producing the bobbin and electrodes available with the present invention in side elevations and an end view.
Figure 9B:
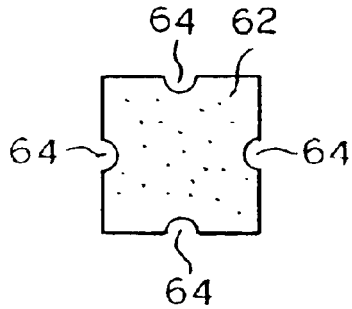
Figure 9C:
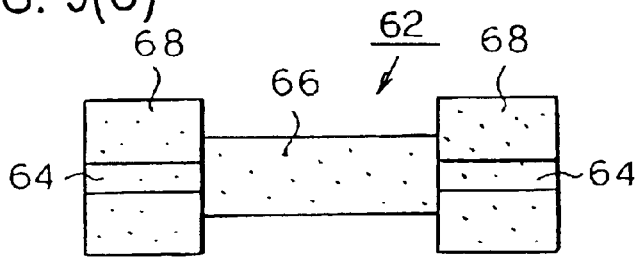
Figure 10D:
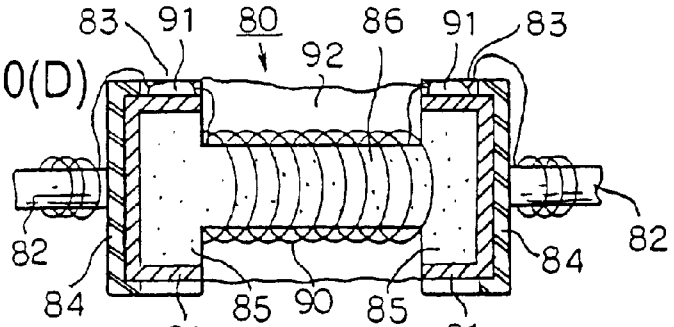
FIG. 10 shows another specific procedure for producing a wire wound electronic component available with the present invention in sections.
Figure 10E:
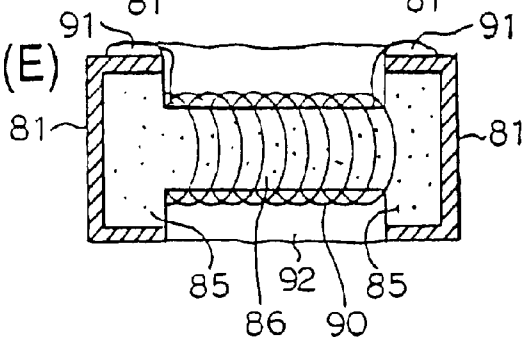
Figure 10A:
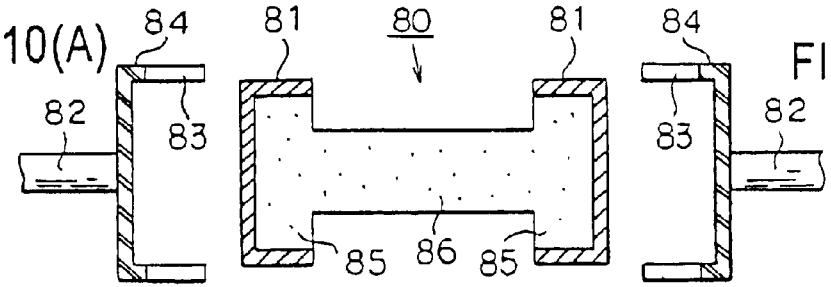
Figure 10B:
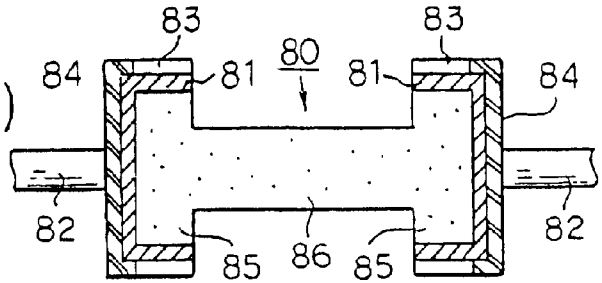
Figure 10C:
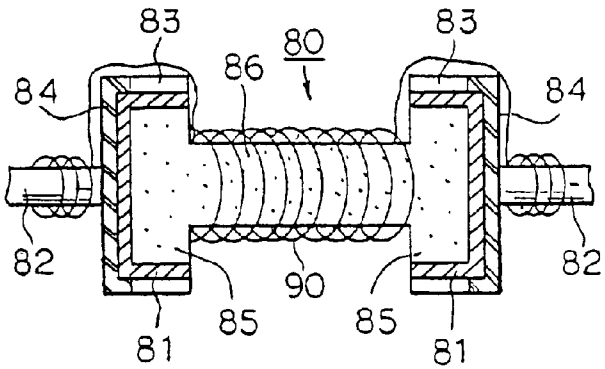

When a block for forming a bobbin is implemented by ceramics, it hardens after baking. In this case, as shown in FIG. 9, a block 62 for forming a bobbin is machined before baking. Specifically, as shown in FIG. 9, (A), the block 62 formed of ceramics and having a rectangular cross-section is prepared before baking. As shown in FIG. 9, (B), grooves 64 are formed in the four sides of the block 62. The block 62 easy to machine in such a condition is formed with a core 66 and flanges 68, as shown in FIG. 9, (C). At this instant, the block 62 may be centered by any one of the schemes stated earlier. Subsequently, the block 62 with the core 66 and flanges 68 is baked.

Figure 11A:
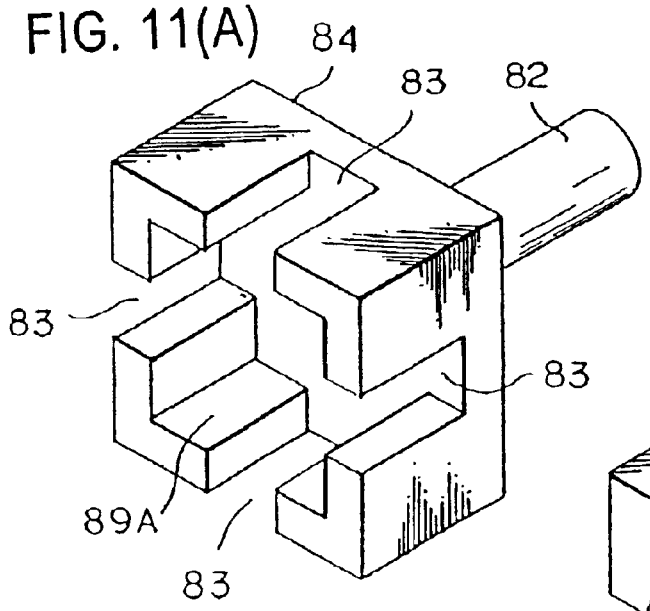
FIG. 11 shows in perspective views specific configurations of a cap applicable to the method shown in FIG. 10.
Figure 11B:
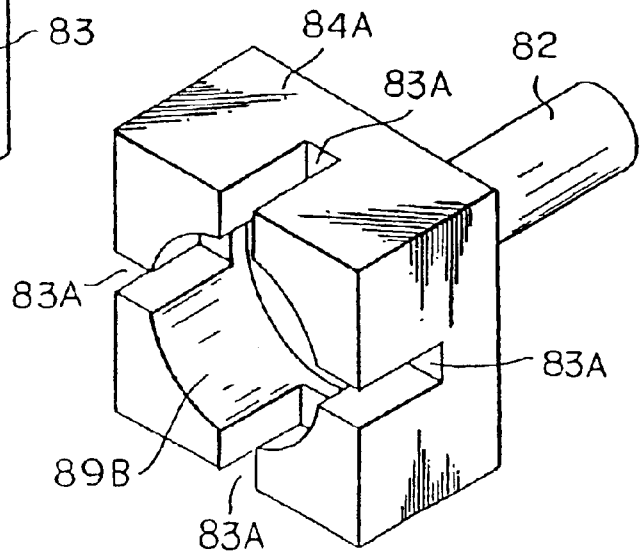
Figure 11C:
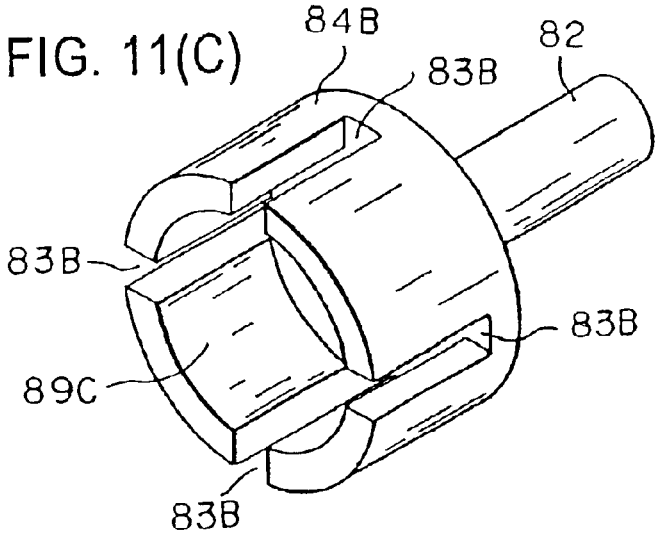

FIG. 10 shows another embodiment of the present invention. As shown in FIG. 10, (A), caps 84 each having a lead 82 are fitted on both ends of a bobbin 80. The bobbin 80 has a core 86 and flanges 85 formed at both ends of the core 86. Electrodes 81 are respectively formed on the flanges 85. If desired, any one of the previously stated columnar blocks may be substituted for the bobbin 80 and machined to form the core 86 and flanges 85 by being centered at the leads 82. FIG. 11, (A), shows a specific configuration of each cap 84. As shown, the cap 84 has a bore 89A for receiving the flange 85 of the bobbin 80. The wall of the bore 89A is formed with slits or windows 83 at positions for connecting leads. FIG. 10, (B), shows the bobbin 80 with the caps 84 fitted thereon.

Subsequently, as shown in FIG. 10, (C), a coil 90 is wound such that it extends from the leads 82 to the core 86 over the flanges 85. Then, as shown in FIG. 10, (D), a conductor protruding from opposite stripped ends of the coil 90 is bonded to the electrode 81 by solder 91 via the slits 83 of the caps 84. A coating or armor of resin 92 is formed on the portion of the coil 90 wound round the core 86. Thereafter, the caps 84 are removed from the bobbin 80 by, e.g., being pulled with the soldered portions of the coil 90 being pressed. As a result, the conductor of the coil 90 is cut off, as shown in FIG. 10, (E). Finally, the electrodes 81 and soldered portions of the bobbin 80 are plated with, e.g., Ni (not shown).

Other specific configurations of the cap 84 are shown in FIGS. 11, (B) and (C). In FIG. 11, (A), a cap 84 has a rectanglar bore 89A and applicable to a block having a rectanglar cross-section. In FIG. 11, (B), a cap 84A has a circular bore 89B, as distinguished from the rectangular bore 89A shown in (A), and slits 83A. The cap 84A is usable when the block 80 for forming a bobbin has a circular cross-section. In FIG. 11, (C), a cap 84B also has a circular bore 89C and slits 83B and applicable to a block having a circular cross-section. I this embodiment, only if a block and caps with leads and each having any desired configuration are combined, a wire wound electronic component can be produced by use of an existing production line for parts with leads.

Figure 12A:
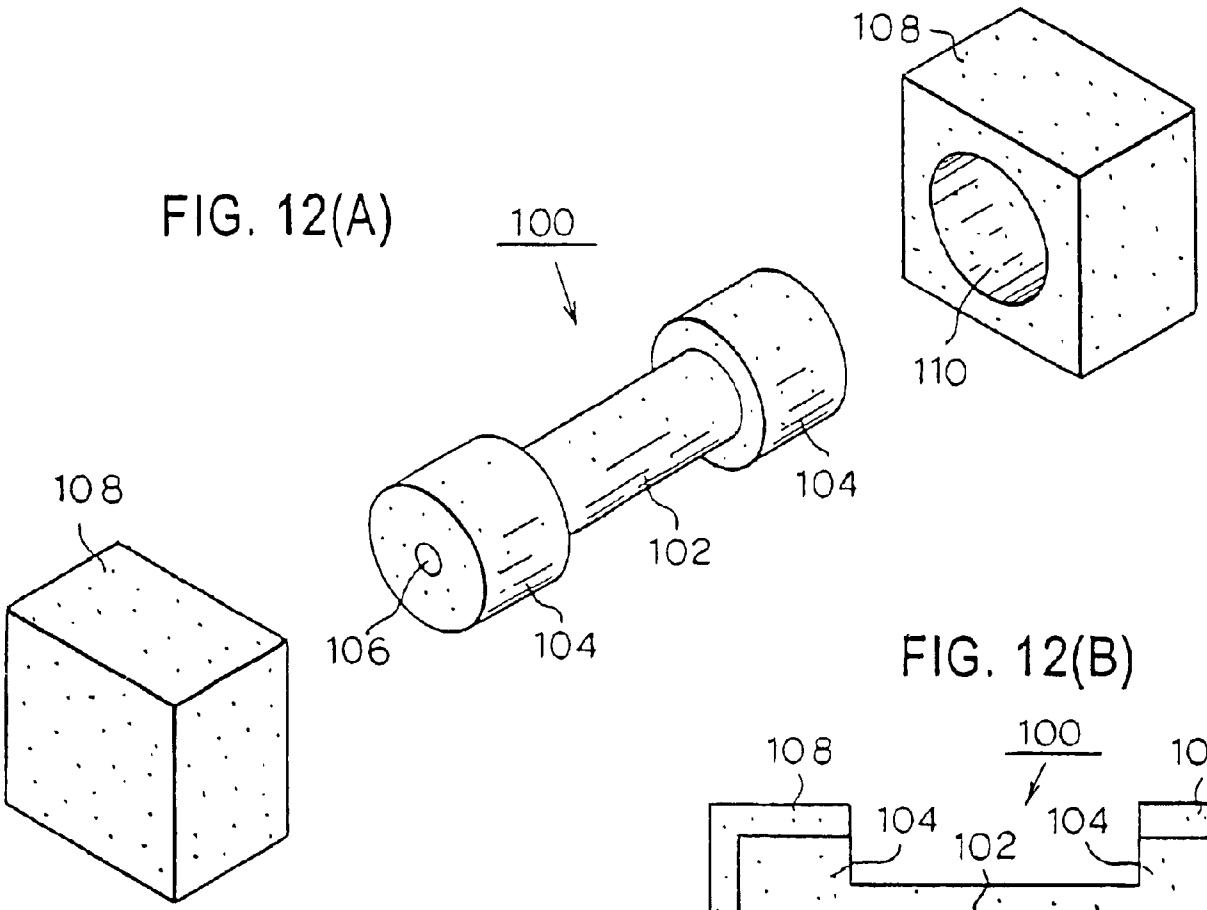
FIG. 12 shows another specific procedure for producing the bobbin available with the present invention in an exploded perspective view and a section.
Figure 12B:
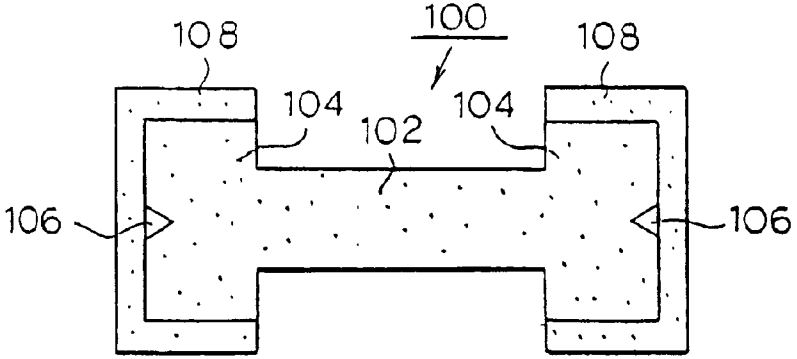
Figure 13A:
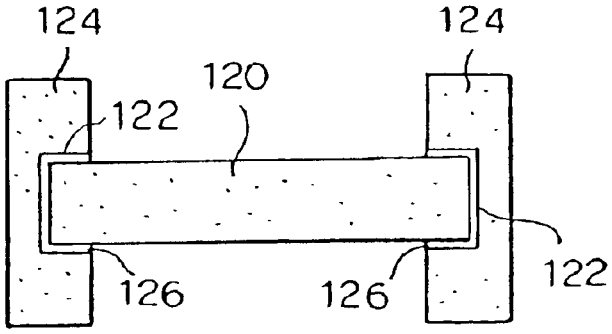
FIG. 13 shows another specific procedure for forming the bobbin available with the present invention in sections and end views.
Figure 13B:
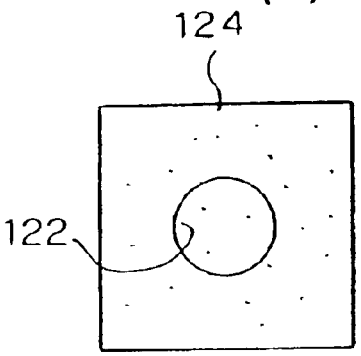
Figure 13C:
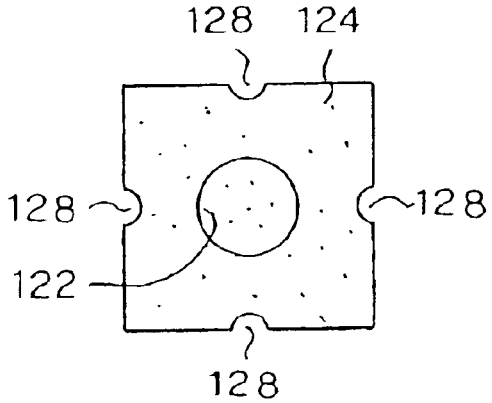
Figure 13D:
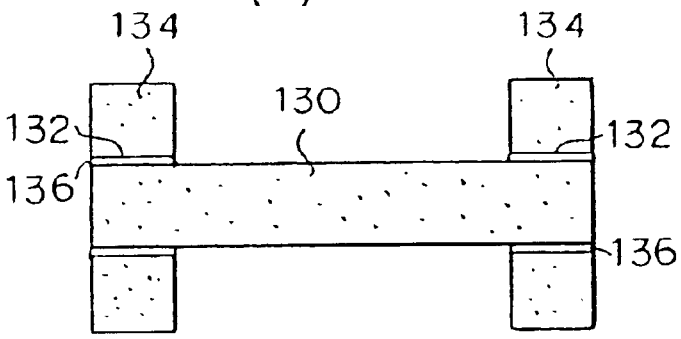
Figure 13E:
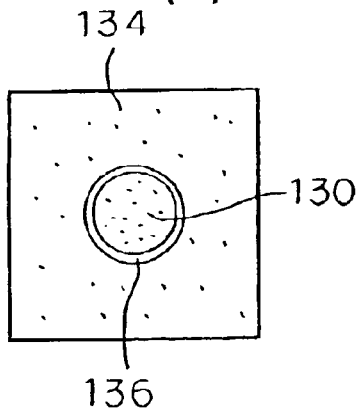
Figure 14A:
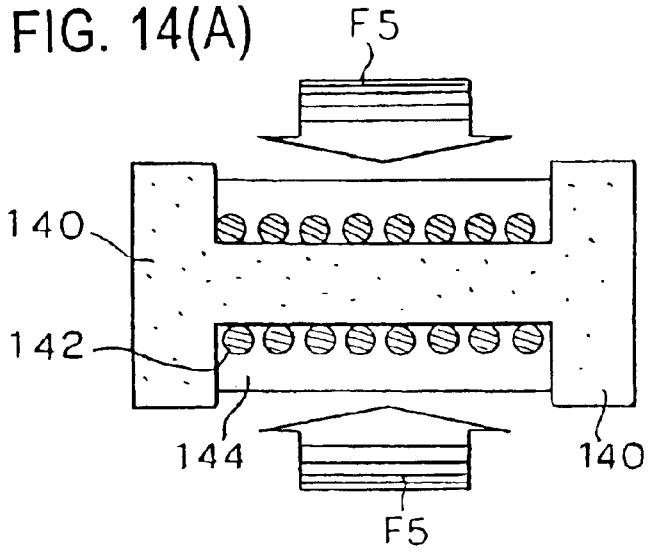
FIG. 14 shows other specific procedures for forming the electronic component in accordance with the present invention in sections and fragmentary enlarged views.
Figure 14B:
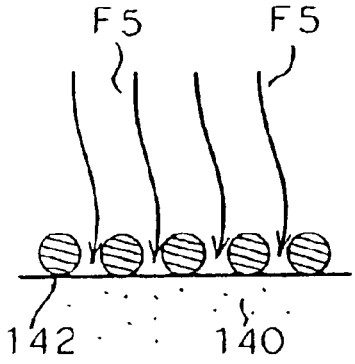
Figure 14C:
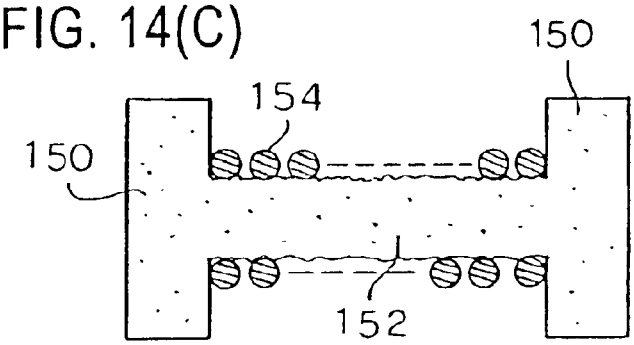
Figure 14D:
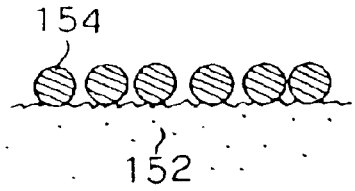

FIG. 12 shows another embodiment which also uses caps. Generally, the flanges of a bobbin should preferably have flat surfaces from the mounting standpoint and have no directivity from the bulk mounting standpoint. A rectangle is one of the shapes of the flanges satisfying the above conditions. On the other hand, a cylinder is desirable from the easy machining standpoint. In the illustrative embodiment, as shown in FIG. 12, (A), rectangular flange caps are bonded to opposite ends of a cylindrical core.

Specifically, a cylindrical block 100 is made up of a core 104 and comparatively thick ends portions 104. Recesses 106 are formed in the opposite end faces of the block 100 for the centering purpose. Flange caps 108 each has a circular bore 110 corresponding to the shape of the end portion 104. The end portions 104 are respectively press-fitted in or adhered to the bores 110 of the flange caps 108. FIG. 12, (B), shows the resulting assembly. In this manner, a bobbin having a cylindrical core and rectangular flanges is produced. Each flange cap 108 may be formed with grooves beforehand, if desired.

FIG. 13 shows modifications of the above embodiment. FIG. 13, (A), shows a cylindrical core member 120 and flanges caps 124 each having a core 122. The flange caps 124 are affixed to the end portions of the core member 120 by an adhesive 126. The flange caps 124 may each have a rectangular end, as shown in FIG. 13, (B). As shown in FIG. 13, (C), grooves 128 may be formed in the four sides of each flange cap 124. FIG. 13, (D) shows a cylindrical core member 130 and flange caps 134 each being formed with a through bore 132. The flange caps 134 are also affixed to the core member 130 by an adhesive 136. FIG. 13, (E), shows the end of the assembly of FIG. 13, (D).

In any of the configurations shown in FIGS. 12 and 13, each cap may be formed with grooves, as needed. Each cap may be formed of ceramics and provided with an electrode on its surface or may be entirely formed of metal. This will allow the entire flanges to serve as heat radiators. For the adhesive, use may be made of an insulating resin, conductive adhesive, solder or the like.

FIG. 14, (A), shows another embodiment which relates to a coil. As shown, a bobbin 140 has a coil 142 wound thereround. A paint 144 is applied to the coil 142 in the form of a coating. In this embodiment, the paint 144 is pressed toward the coil 142, as indicated by arrows F5. Then, as shown in FIG. 14, (B), in an enlarged scale, the paint 144 penetrates into the gaps between the turns of the coil 142 and thereby enhances insulation between the turns. This successfully increases the withstanding voltage of the coil 144. FIG. 14, (C) shows a bobbin 150 including a core 152 whose surface is roughened. As shown in FIG. 14, (D), in an enlarged scale, the rough surface of the core 152 prevents the turns of the coil 154 from being dislocated.

Figure 15A:
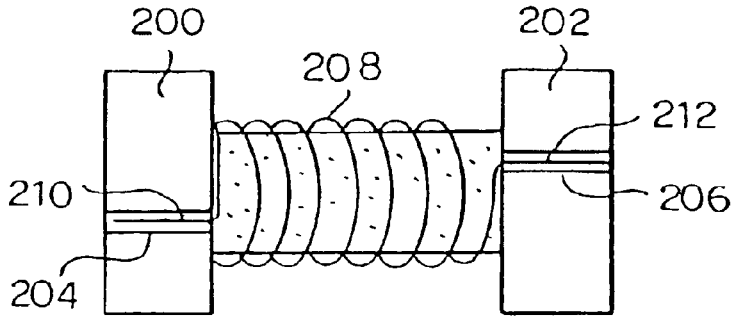
FIG. 15 shows other specific configurations of the electronic component in accordance with the present invention in side elevations and a perspective view.
Figure 15B:
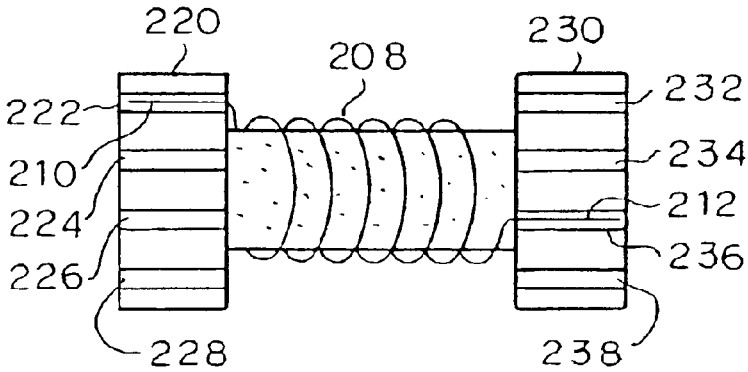
Figure 15C:
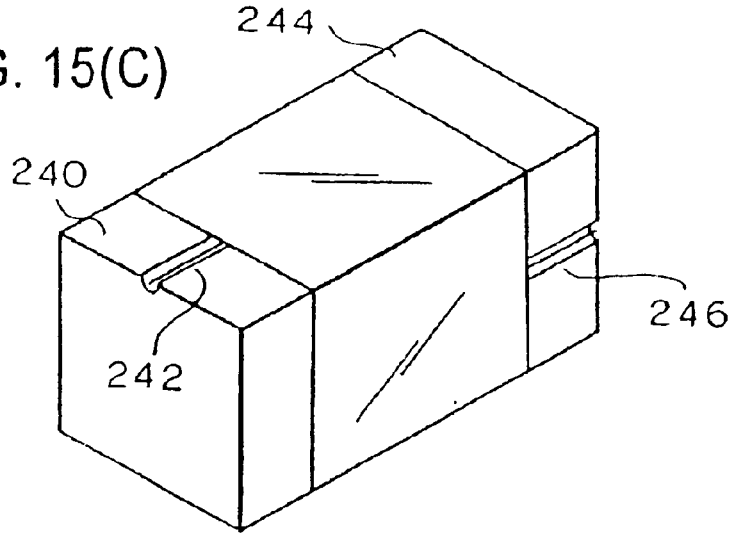
Figure 16A:
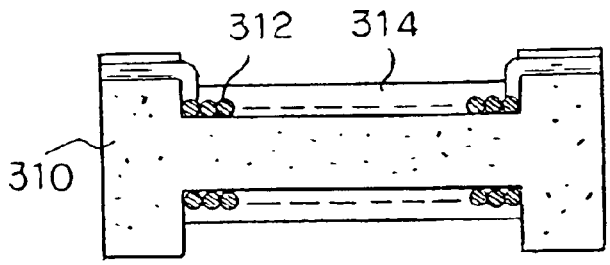
FIG. 16 shows other specific configurations of the electronic component in accordance with the present invention in sections.
Figure 16B:
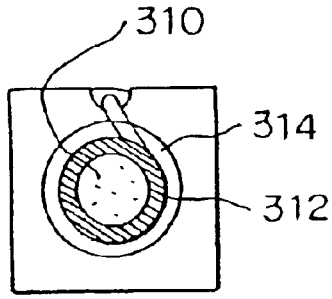
Figure 16C:
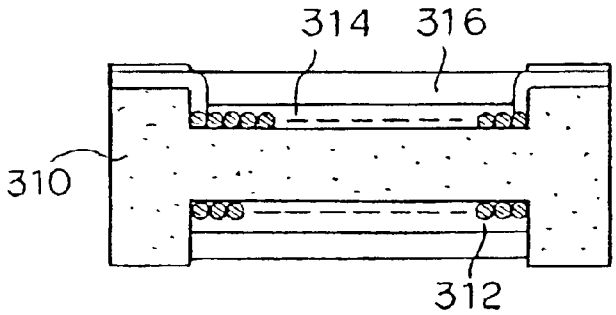
Figure 16D:
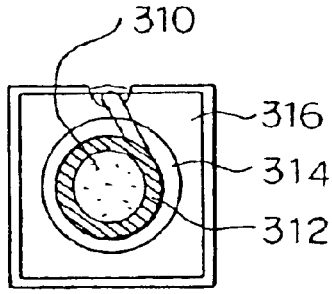

FIG. 15 shows other embodiments of the present invention relating to the positions where the conductor of a coil is connected to electrodes portions(corresponding to flanges and electrodes). FIG. 15, (A), shows electrode portions 200 an 202 having grooves 204 and 206, respectively. As shown, the grooves 204 and 206 are deviated from each other with respect to the lengthwise direction of the bobbin. A coil 208 has conductor portions 210 and 212 bonded to electrodes in the grooves 204 and 206, respectively. With this configuration, it is possible to reduce the stress ascribable to the shrinkage of a coating resin.

FIG. 15, (B), shows an electrode portion 220 formed with grooves 222, 224, 226 and 228, and an electrode portion 230 formed with grooves 232, 234, 236 and 238. The number of turns of the coil 208 is variable, depending on the grooves to which the stripped portions 210 and 212 of the coil 208 are connected. This allows L and Q to be readily adjusted in order to enhance productivity.

FIG. 15, (C), shows a bobbin having a rectangular cross-section and including an electrode portion 240 and a flange portion 244. Grooves 242 and 246 are respectively formed in the electrode portion 240 and flange portion 244, but in different planes of the rectangle. This also allows the number of turns of the coil 208 and therefore L and Q to be adjusted with ease. If desired, the configurations shown in FIG. 15, (B) and (C) may be combined in order to adjust L and Q with higher accuracy.

FIG. 16 shows another embodiment which applies a paint or a resin to a coil in two consecutive steps. First, as shown in FIG. 16, (A), in a section and in FIG. 16, (B), in a cross-section, a paint 314 is applied to a coil 312 in a cylindrical configuration. The coil 312 is wound round a bobbin 310 (electrodes are not shown). Then, as shown in FIG. 16, (C), in a section and in FIG. 16, (D), in a cross-section, a paint 316 is applied over the paint 314 in a rectangular configuration. If the undercoating 314 has a low viscosity, it will successfully penetrate into the gaps between the turns of the coil 312, surely affixing the coil 312 and insulating its turns. If the overcoating 316 has a high viscosity, it can have its thickness adjusted and trimmed. Three or more paints may be sequentially applied, if desired.

Figure 17A:
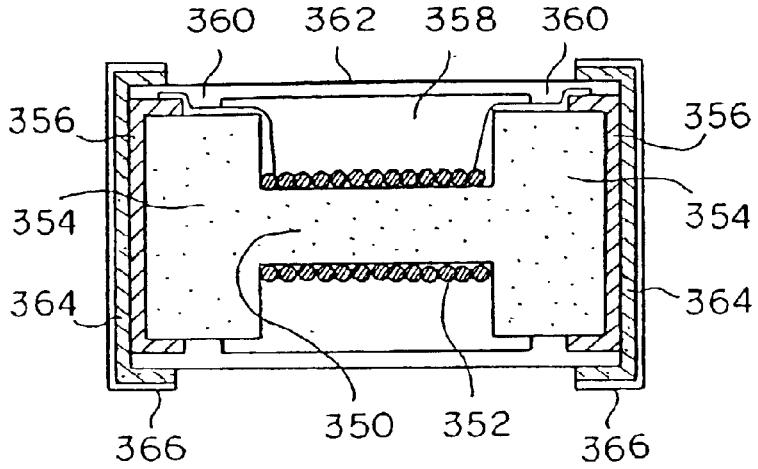
FIG. 17 shows other specific configurations of the electronic component in accordance with the present invention in sections.
Figure 17B:
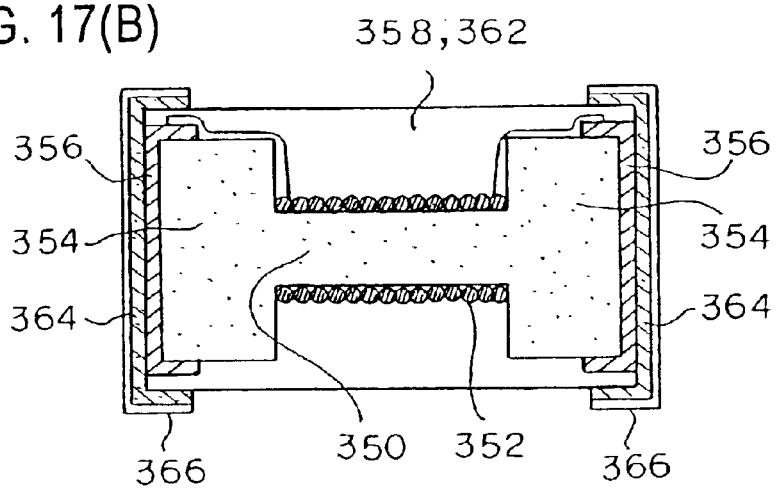
Figure 17C:
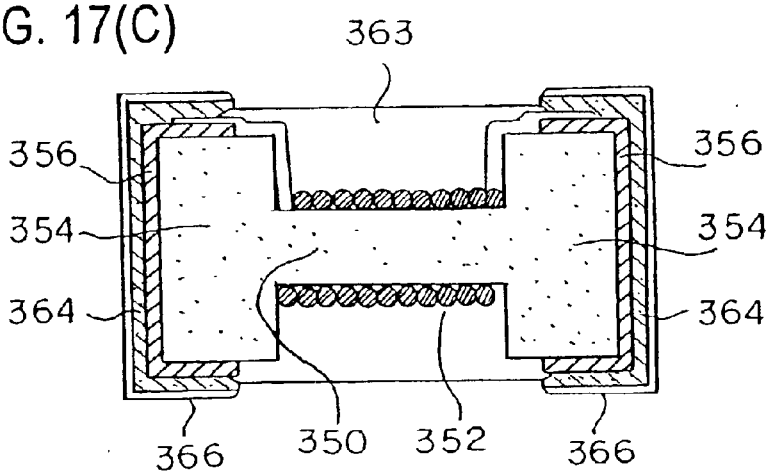
Figure 18A:
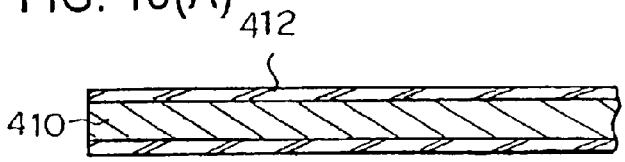
FIG. 18 shows specific methods of bonding the conductor of a coil and electrodes in sections.
Figure 18B:
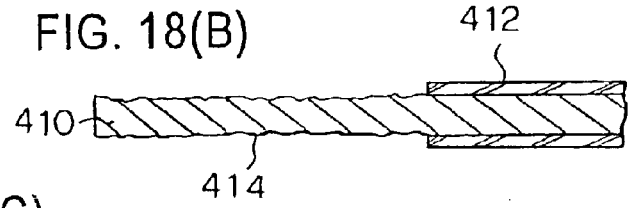
Figure 18C:
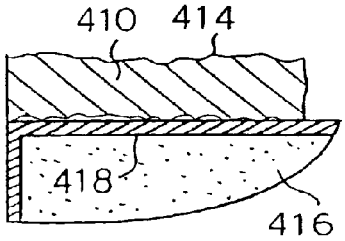
Figure 18D:
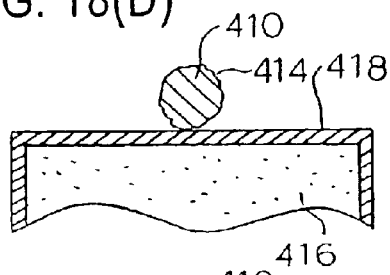
Figure 18E:
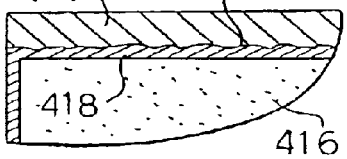
Figure 18F:
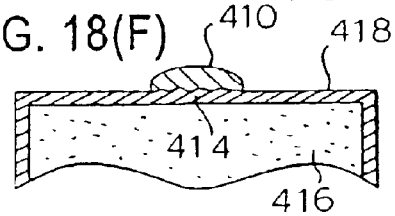
Figure 18G:
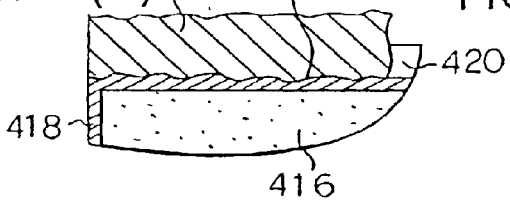
Figure 18H:
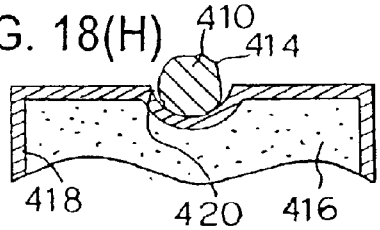
Figure 18I:
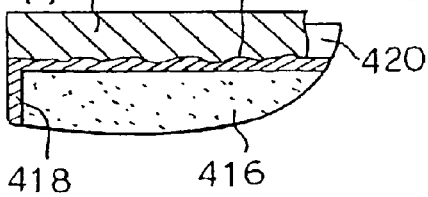
Figure 18J:
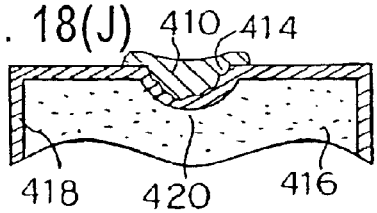
Figure 18K:
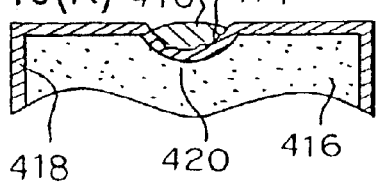

FIG. 17 shows other embodiments of the present invention. FIG. 17, (A), shows a core 350 having a coil 352 wound thereround. A conductor protruding from opposite stripped ends of the coil 352 are bonded to electrodes 356 formed on flanges 354, but a gap 360 exists between each electrode 356 and a coating or armor 358. The gap 360 is apt to bring about various troubles including the breakage of the coil 352. In this embodiment, a protective coating 362 is provided on the coating 358. At each end of the bobbin, a conductive resin 364 is applied by dipping or transfer and bonded to the electrode 356, and then a plating 366 is formed on the conductive resin 364. The protective coating 362 protects such gaps 360 and thereby obviates the above troubles. While the coating 358 and protective coating 362 may be formed independently of each other, they may be formed at the same time, as shown in FIG. 17, (B). Further, the protective coating 358 may be formed only in the gaps in the form of stripes. FIG. 17, (C) shows a structure in which the gaps 360 are protected by a conductive resin 363.

FIG. 18 shows another embodiments of the present invention. As shown in FIG. 18, (A), a wire to be used as a coil is made up of a conductor 410 and a covering 412 covering the conductor 410 and formed of an insulator. To connect the conductor to an electrode as a lead, the covering 412 is removed by some suitable method.

As shown in FIG. 18, (B), the surface of the conductor 410 is roughened in order to form irregularities (rough surface) 414. This can be done only if, e.g., the surface of the conductor 410 is mechanically rubbed when the covering 412 is peeled off. As shown in FIGS. 18, (C) and (D) which are respectively a longitudinal section and a vertical section perpendicular to the longitudinal direction, the conductor 410 with the irregularities 414 is positioned on an electrode 418 formed on a flange 416. In this condition, the conductor 410 is bonded to the electrode 418 by heat pressure welding, ultrasonic welding or similar technology. As shown in FIGS. 18, (E) and (F), the conductor 410 bites deeply into the electrode 418 due to the irregularities 414. This increases the bonding strength due to a so-called anchor effect.

A modification of the illustrative embodiment is shown in FIGS. 18, (G)–(K). As shown, the flange 416 is formed with a groove 420 having a generally U-shaped section (see (G) and (H)). When the conductor 410 is bonded to the electrode 418 in the groove 420, the irregularities 414 of the conductor 410 are entangled with the electrode 418. This also increases the bonding strength between the conductor 410 and electrode 418 (see (I) and (J)). If desired, the conductor 410 may be fully received in the groove 420 in order to facilitate mounting.

In the illustrative embodiment, the groove 420 increases the area over which the conductor 410 and electrode 418 are bonded together. This further increases the bonding strength. In addition, the conductor 410 is received in the groove 420 while protruding from the electrode 418 little. Consequently, the electrode 418 can be stably bonded to an electrode pattern formed on a circuit board (not shown).

Figure 19A:
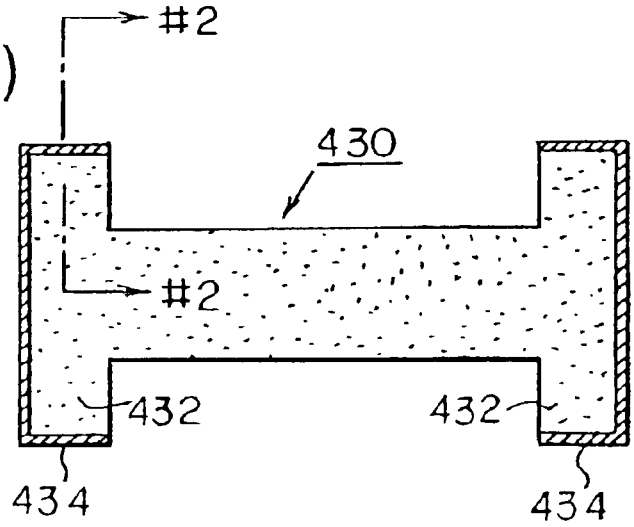
FIG. 19 shows another specific method of bonding the conductor and electrodes in sections.
Figure 19B:
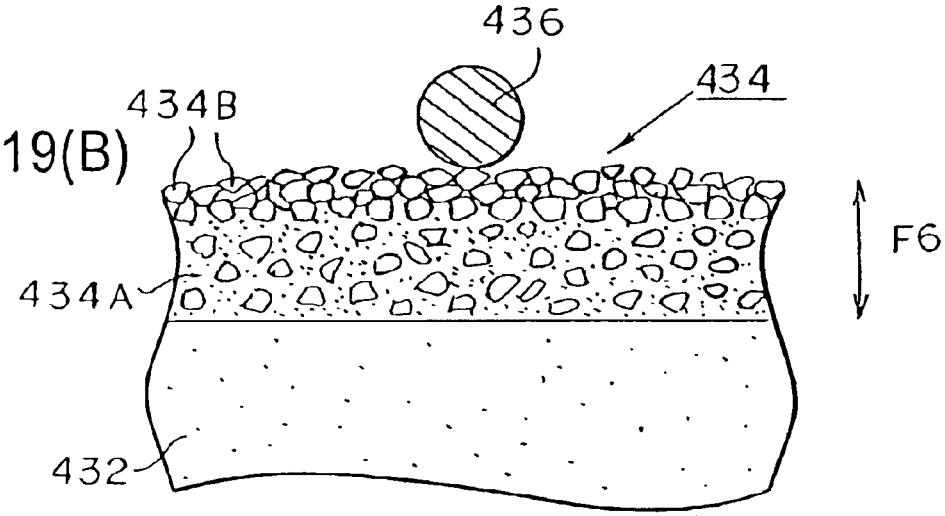
Figure 19C:
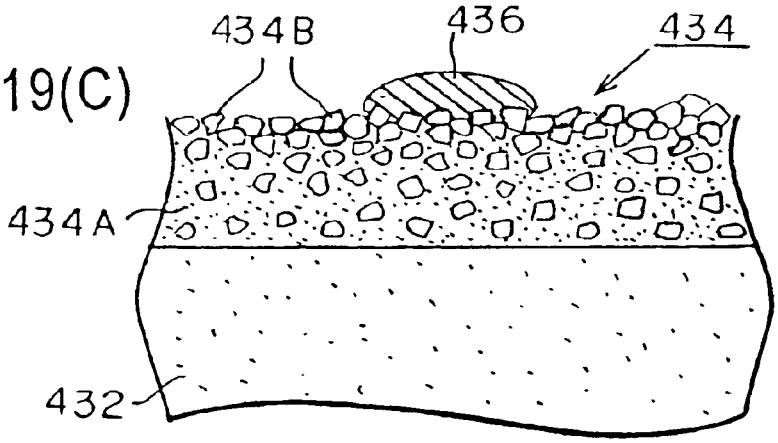

FIG. 19 shows another embodiments of the present invention. As shown in FIG. 19, (A), a bobbin 430 has flanges 432 at opposite ends thereof. Each flange 432 has its side face and end face covered with an electrode 434. In FIG. 19, (B) and (C) are fragmentary sections along line #2—#2 of FIG. 19, (A).

The electrodes 434 are implemented by a silver paste or similar conductive paste containing glass frit as a binder. A conductive adhesive (or conductive resin) contains an organic component (e.g. epoxy resin, phenol resin or acryl resin) as a binder. In the illustrative embodiment, each electrode 434 is configured such that the density of glass frit 434A is high in the vicinity of the flange 432 and sequentially decreases toward the its surface, as indicated by a double-headed arrow in FIG. 19, (B). Stated another way, the glass frit 434 is densely arranged in the vicinity of the flange 432 while silver particles 434B are densely arranged in the vicinity of the surface of the electrode 434 so as to form a rough surface. Such a density gradient is achievable if the baking temperature is adjusted or if the wettability with the material of the flange 432 is adjusted. As shown in FIG. 19, (C), a conductor 436 included in a coil (not shown) is bonded to the electrode 434 by heat pressure welding or similar technology.

Generally, the bonding strength of a silver paste increases with an increase in the density of glass frit. Therefore, a core material constituting the flange 432 and the silver paste forming the electrode 434 can be connected together by a great bonding strength due to the high glass frit density. On the other hand, as shown in FIGS. 19, (B) and (C), the silver particles 434B forming the rough surface ensure rigid bond between the silver paste and the conductor 436 due to the anchor effect, as in the previous embodiment.

As stated above, the above embodiment enhances both the close contact of the electrode 434 and flange 432 and the rigid bond between the electrode 434 and the conductor 436, providing the assembly with high reliability. If desired, a groove may be formed in the flange 432 in order to further enhance the rigid bond, as in the previous embodiment.

Figure 20A:
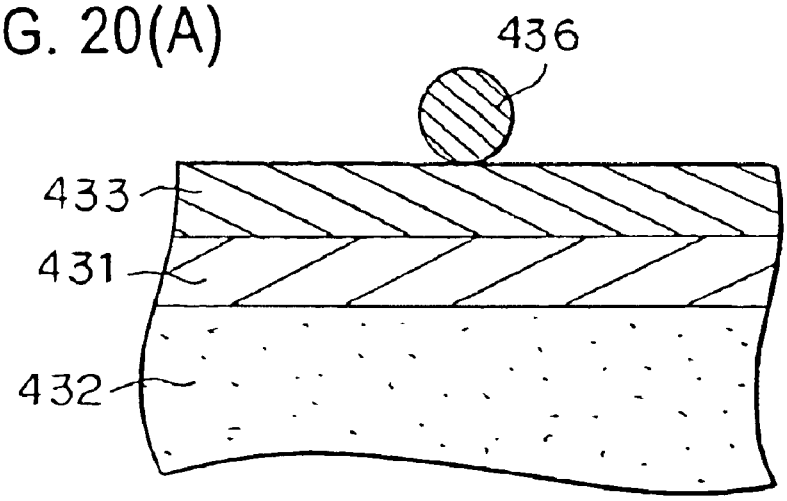
FIG. 20 shows a modification of the method of bonding the conductor and electrodes in a section and a perspective view.
Figure 20B:
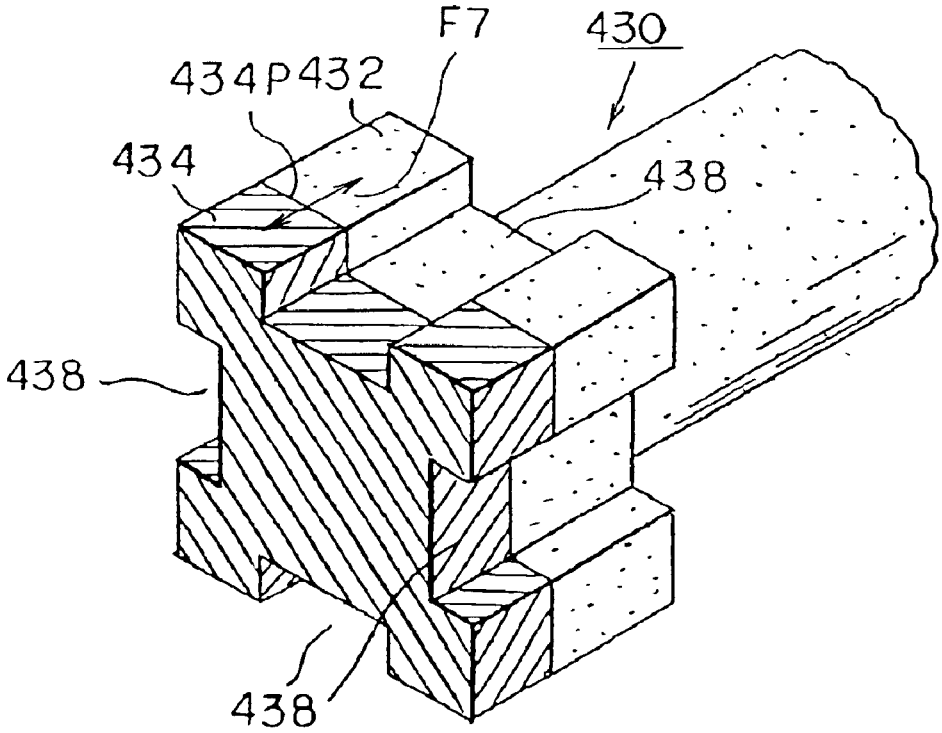

The electrode 434 may be implemented as a plurality of layers, if desired. For example, as shown in FIG. 20, (A), the electrode 432 may be made up of a silver electrode 431 formed on the flange 432 and an Sn—Pb plating layer 433 formed on the silver electrode 431. In such a case, the conductor 436 is positioned on the plating layer 433 and subjected to fusion bonding (including alloy bonding) using an ultrasonic wave and heat. This is also successful to achieve the advantages of the second embodiment. The mechanical bonding shown in FIG. 19 or the fusion bonding shown in FIG. 20, (A) may be replaced with diffusion bonding in which a conductor and an underlying material are bonded by dispersion. Of course, two or more of the above bonding schemes may be combined.

As shown in FIG. 20, (B), the position 34P where the end of the electrode 434 is located on the side face of the flange 432 may be adjusted in the direction indicated by a double-headed arrow. This also allows the bonding strength between the electrode 434 and the conductor 436 to be adjusted. The specific configuration shown in FIG. 20, (B), includes grooves 438 having a relatively great width. The grooves 438 each allows the conductor 436 to be bonded to the electrode 434 in its oblique position with respect to the lengthwise direction of the bobbin (double-headed arrow F7). The conductor 436 is therefore free from sharp bends and therefore from breakage.

Figure 21A:
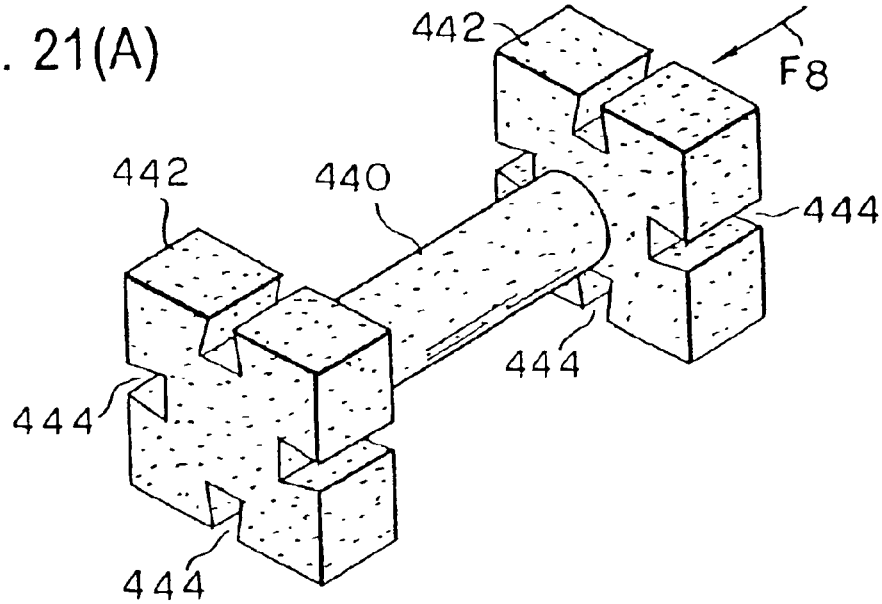
FIG. 21 shows another specific configuration of the bobbin in a perspective view, and shows a specific method of bonding the conductor to the bobbin in sections.
Figure 21B:
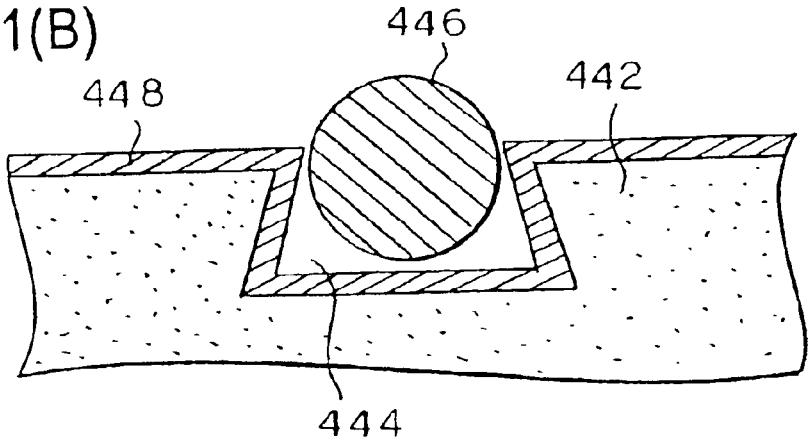
Figure 21C:
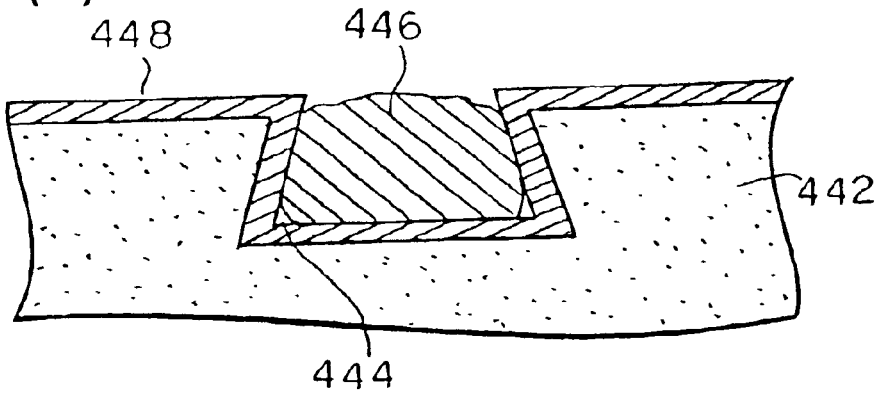

FIG. 21 shows another embodiments of the present invention. As shown in FIG. 21, (A), a bobbin has a cylindrical core 440 and rectangular flanges 441 formed at opposite ends of the core 440. Each flange 442 is formed with grooves 444 in its four sides; each groove 444 is located at substantially the center of the respective side. FIG. 21, (B), is a section as seen in the direction indicated by an arrow F8 in FIG. 21, (A). As shown, an electrode 448 is formed on the surface of each flange 442. A conductor 446 included in a coil is received in the groove 444 and bonded to the electrode 448.

In the illustrative embodiment, the grooves 444 each is tapered from the inside toward the outside of the flange 442. Therefore, as shown in FIG. 21, (C), the conductor 446 bonded to the electrode 448 bites into the walls of the groove, 444. Generally, the bonding strength between an electrode and a conductor depends on bonding conditions and is apt to cause the conductor to come off. In this embodiment, the conductor 446 biting into the walls of the tapered groove 444 maintain the bond despite some scattering in bonding conditions. This prevents the conductor 446 from coming off the electrode.

Figure 22A:
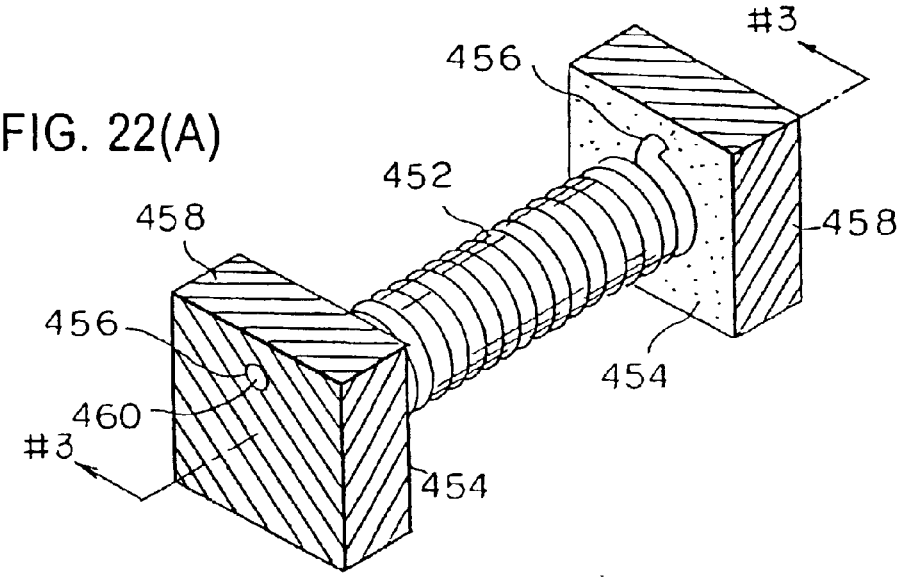
FIG. 22 shows another specific method of bonding the conductor and electrodes in a perspective view and sections.
Figure 22B:
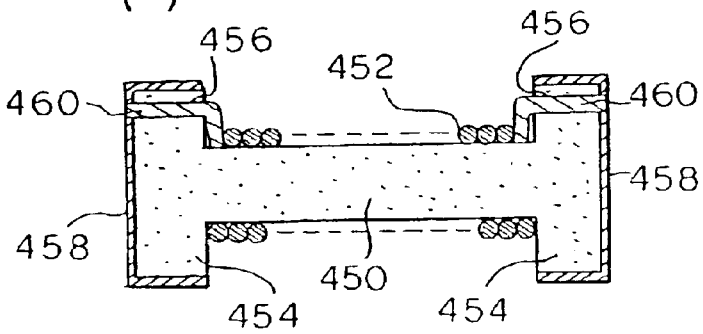
Figure 22C:
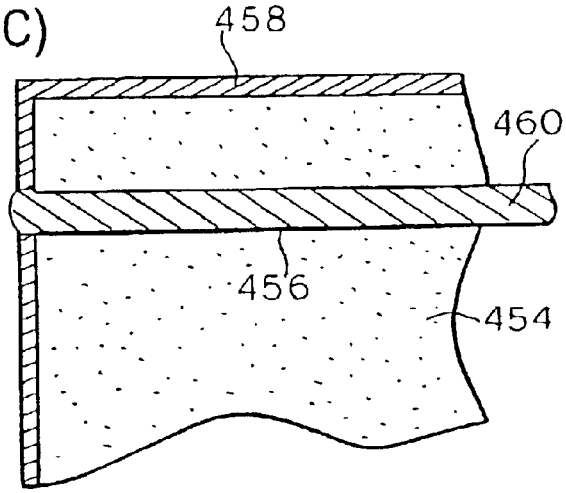

FIG. 22 shows another embodiments of the present invention. In FIG. 22, (A) is a perspective view, (B) is a section along line #3—#3 of (A), and (C) is an enlarged view of a conductor bonding portion.

As shown, a bobbin has a cylindrical core 450, a coil 452 wound thereround, and flanges 454 formed at opposite ends of the core 450. A through hole 456 extends throughout each flange 454 in the lengthwise direction of the bobbin. An electrode 458 is formed on the four sides and end of each flange 454. The coil 452 is stripped off at its both ends in order to expose its conductor 460. The opposite ends of the conductor 460 are respectively inserted into the through holes 456 of the flanges 456 and bonded to the electrodes 458 by, e.g., a conductive paste, as belt shown in FIG. 22, (C).

As stated above, in this embodiment, the conductor 460 is not positioned on the sides of the flanges 454, but is inserted into the flanges 454. In this condition, a minimum of extraneous force is allowed to act on the conductor 460, so that the bond between the conductor 460 and the electrode 458 is ensured. Further, because the sides of the flanges 454 are simply flat, the electrodes 458 can be desirably bonded to a conductive pattern provided on a circuit board (not shown). In addition, the influence of an extraneous force on the conductor 460 decreases as the distance between the through holes 56 and the core 450 decreases, preventing the conductor 460 from being broken.

Figure 23A:
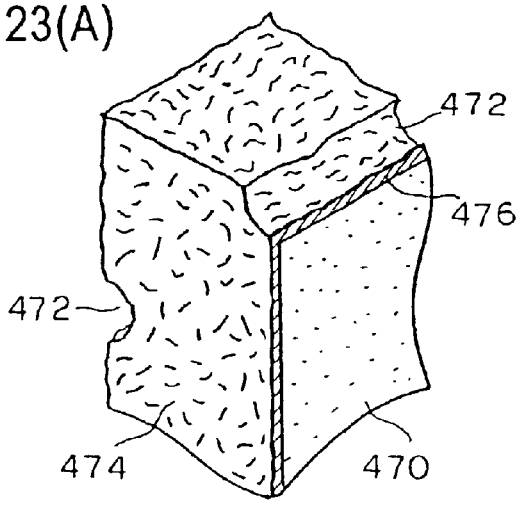
FIG. 23 shows other specific methods of bonding the conductor and electrodes in perspective views.
Figure 23B:
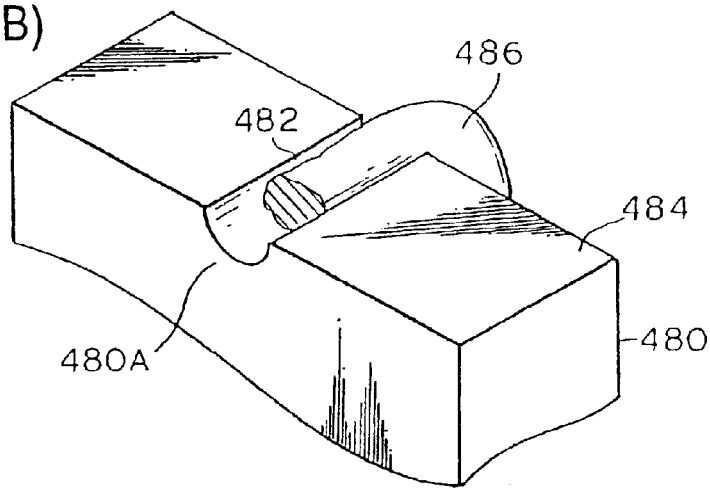
Figure 23C:
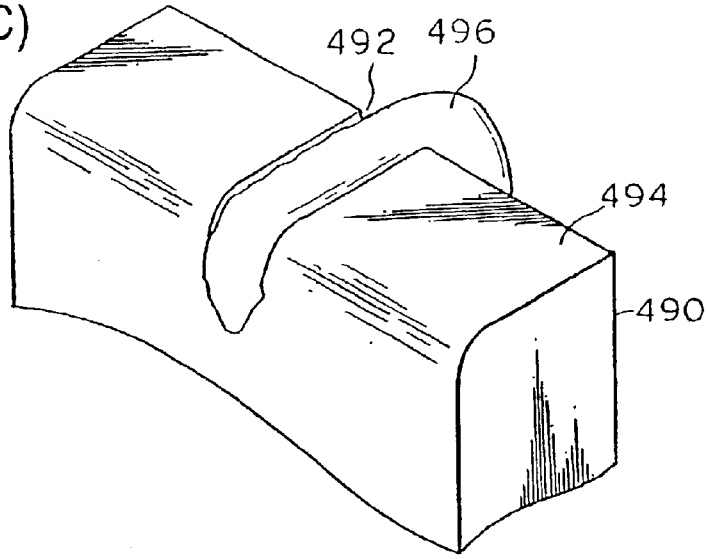

Another embodiment of the present invention will be described with reference to FIG. 23. As shown in FIG. 23, (A), a flange 470 is formed with grooves 472 each having a generally U-shaped section in its sides. An electrode 474 is formed on the sides and end of the flange 470. In the illustrative embodiment, irregularities 476 are formed on the surface of the electrode 474 by, e.g., sand blasting or selective etching. When conductor protruding from a coil (not shown) is bonded to the electrode 474 within the associated groove 472, the conductor and the irregularities 476 of the electrode 474 are entangled together. As a result, rigid bond between the conductor and the electrode 474 is guaranteed. If desired, the irregularities 476 of the electrode 474 may be combined with the irregularities 414 of the first embodiment in order to further enhance the bonding strength.

The groove 472 increases the area over which the conductor and electrode 474 are bonded together. This additionally increases the bonding strength. Moreover, the conductor is received in the groove 472 while protruding from the electrode 474 little. Consequently, the electrode 474 can be stably bonded to an electrode pattern formed on a circuit board (not shown).

In FIG. 23, (B), another embodiment of the present invention is shown. As shown, a flange 480 is formed with a groove 482 and with an electrode 484 on its sides and end. In this embodiment, the end of a conductor 486 is bonded to the electrode 484 at a position inward of the end 480A of the flange 480, as illustrated. Should the end of the conductor 486 be extended to the end 480A of the flange 480, it might be rubbed at the time of plating or bulk mounting and might cause the conductor 486 to come off the electrode 484.

In FIG. 23, (C), another embodiment of the present invention is shown. As shown, a flange 490 is formed with a groove 492 and with an electrode 494 on its sides and end. In this embodiment, the end of a conductor 496 protrudes from the groove 492 and is turned round to the end of the flange 490 along the rounded edge of the groove 492. In this condition, the conductor 496 is bonded to the electrode 494. Because the end of the conductor 496 is turned round to the end of the flange 490, the area over which the conductor 496 and electrode 494 are bonded together is increased. This increases the bonding strength between the conductor 496 and the electrode 494 and thereby prevents the end of the conductor 496 from coming off at the time of plating or mounting.

Figure 24A:
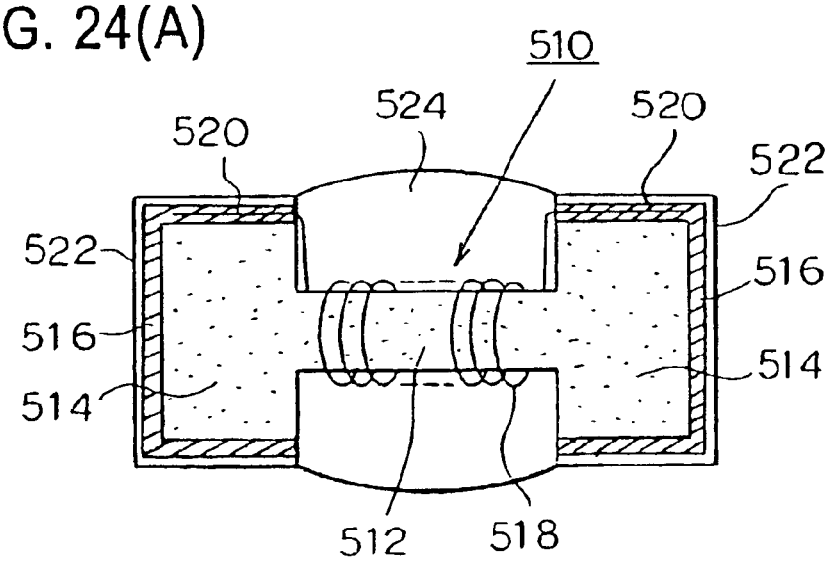
FIG. 24 shows other specific configurations of a coating in a section, an end view, and a side elevation.
Figure 24B:
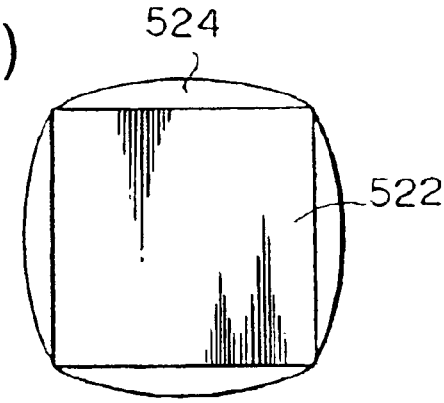
Figure 24C:
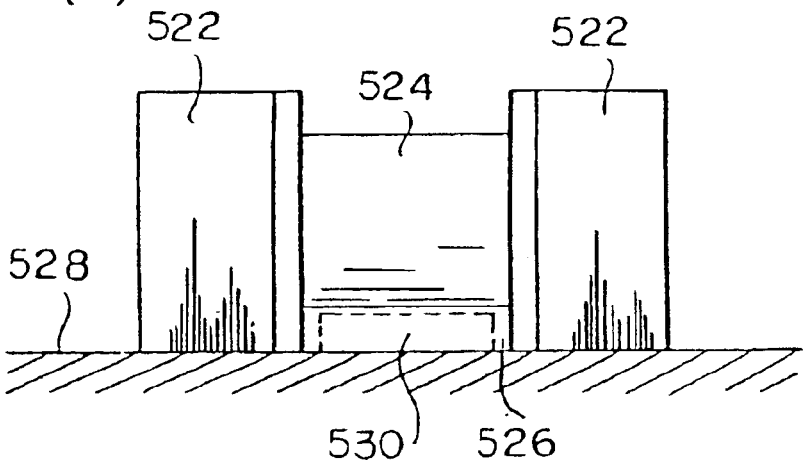
Figure 25A:
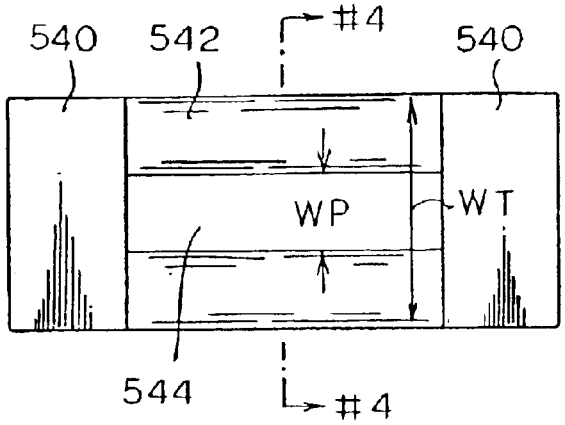
FIG. 25 shows other specific configurations of the coating and a specific mounting condition in a side elevation, a section and an end view.
Figure 25B:
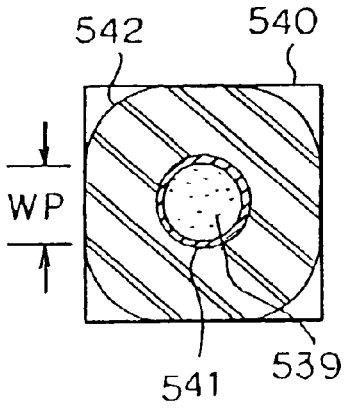
Figure 25C:
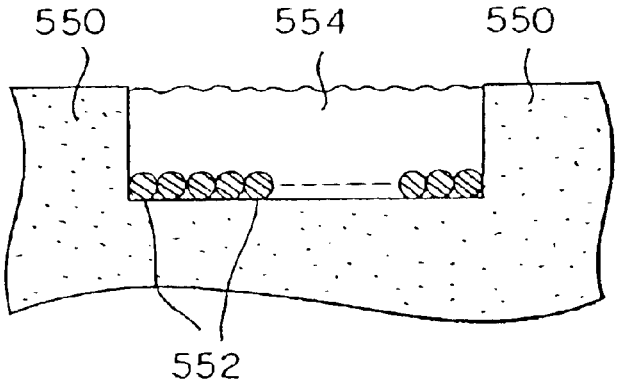
Figure 25D:
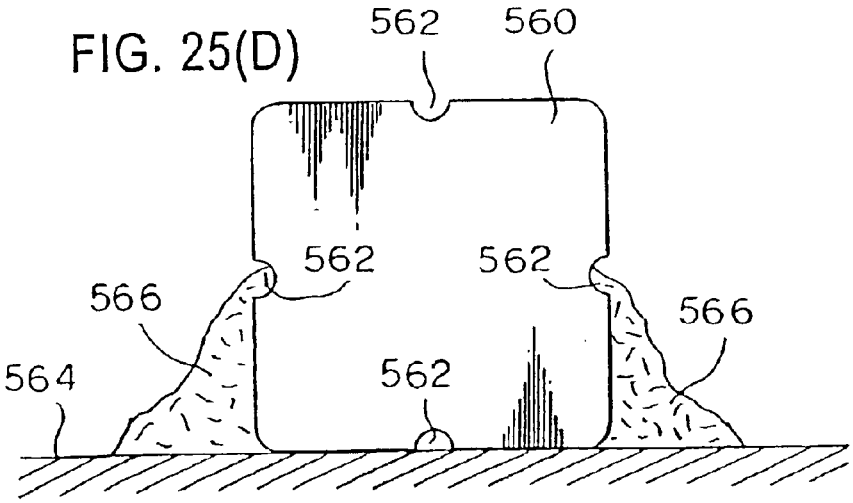

Reference will be made to FIG. 24 for describing an embodiment so configured as to improve the flatness of an armor portion. In FIG. 24, (A), is a section showing an electronic component embodying the present invention and provided with an armor portion. As shown, a bobbin 510 is made up of a core 512 and rectangular flanges 514 formed at both ends of the core 512. An electrode 516 is formed on the sides and end of each flange 514. A coil 518 is wound round the core 512 has a conductor 520 protruding from opposite stripped ends thereof. Both ends of the conductor 520 are respectively bonded to the electrodes 516 by heat pressure welding or similar technology. A plating 522 is provided on each electrode 516 and implemented by, e.g., Ni.

An armor in the form of a coating 524 is provided on the coil 512 by use of a paint or a resin. As shown in FIG. 24, (B) which is a side elevation, the coating 524 is sized great enough to protrude beyond the plating 522. In this condition, the coating 524 is ground or otherwise machined in order to remove its portions protruding beyond the plating 522. As a result, the coating 524 is provided with a square section having flat sides, which can be desirably sucked. In addition, the flat sides enhance the stability of the assembly on a circuit board. Further, the coating 524 may be ground to a position deeper than the sides of the flanges 514 in order to accurately maintain the distance between assembly and the circuit board. Grinding shown and described is a specific method of increasing the flatness may be replaced with injection molding using a metal mold.

FIG. 24, (C), shows the electronic part mounted on a circuit board 528. As shown, a gap 526 exists between the coating 524 and the circuit board 528. The electronic part is mounted such that another part 530 is accommodated in the gap 526. In the illustrative embodiment, the gap 526 is so formed as to leave some coating 524 in the vicinity of the flanges 514, as illustrated. This protects the bond between the conductor 520 of the coil 518 and the electrodes 516 from the influence of the grinding of the coating 524.

An alternative embodiment of the present invention is shown in FIGS. 25, (A) and (B), and relates to the ratio of the flat portion of the coating. In FIG. 25, (A) is a plan view while (B) is a section along line #4—#4 of (A). While the coating should preferably be flat from the suction and stability standpoint, it does not have to be entirely flat. As shown in FIGS. 25, (A) and (B), a coil 541 is wound round a core 539 having rectangular electrode portions 540 at its both ends. In this embodiment, a coating 542 has sides each having a flat portion 544 whose width WP is only 30% of the width WT of the entire side. Experiments showed that even with this degree of flatness, the electronic part can be desirably sucked and held stable on a circuit board. It should be noted that the flatness refers not only to complete flatness but also to flatness with some degree of curvature.

In FIG. 25, (C) shows another embodiment of the present invention. As shown, a coating 554 surrounding a coil 552 between flanges 550 has its surface roughened, i.e., formed with fine irregularities. For this purpose, (1) the coating 554 may be implemented by a paint whose viscosity is high enough to cause the contour of the coil 552 to slightly appear on the surface of the coating 554, or (2) a filler having a preselected particle size may be mixed with the paint in order to roughen the surface of the coating 554. The fine irregularities of the coating 554 reduce static electricity ascribable to the rubbing of electronic parts at the time of bulk feed. In addition, the fine irregularities allow a minimum of displacement of the electronic part to occur when a sucking nozzle is shifted at the time of mounting.

FIG. 25, (D), shows another embodiment of the present invention relating to a conductive paste on a circuit board, e.g., soldering. As shown, grooves 562 are formed in the four sides of an electrode 560. A conductor protruding from a coil(not shown) is bonded in any one of the grooves 562. Such an electronic part is positioned on a circuit board 564, as shown in FIG. 25, (D). When solder 566 is applied to the electronic part, it is drawn into the grooves 562. The solder 566 therefore forms desirable fillets and ensures a great bonding strength even if its amount is small. This is desirable for a small size, light weight configuration. Should solder be applied to the entire electrode 560, as has been customary, the electronic part might break due to the influence of the solder.

Figure 26A:
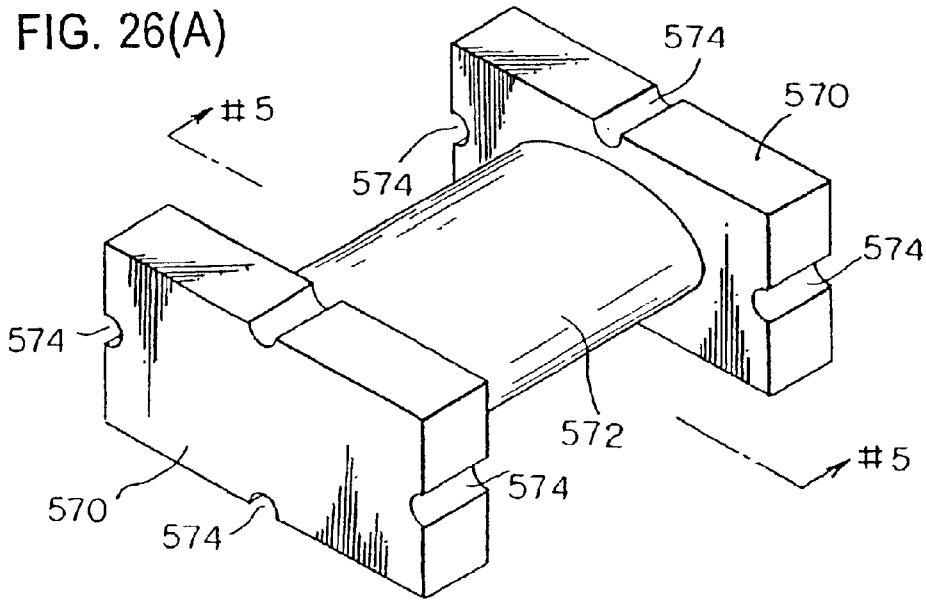
FIG. 26 shows another specific configuration of the bobbin in a perspective view and a section, and shows another specific configuration of the electronic part of the present invention in a fragmentary perspective view.
Figure 26B:
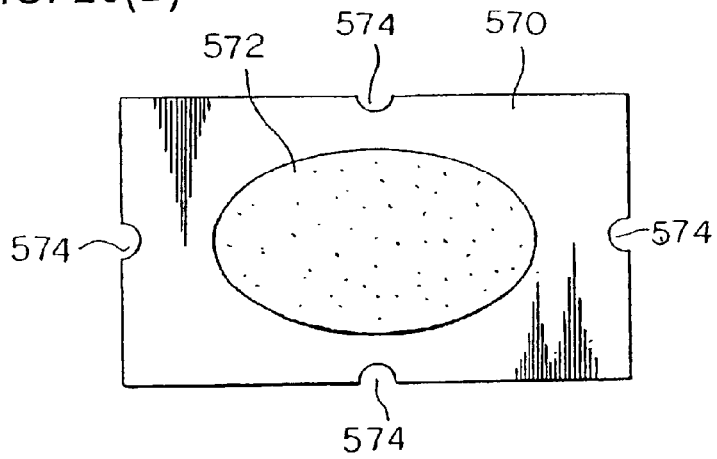
Figure 26C:
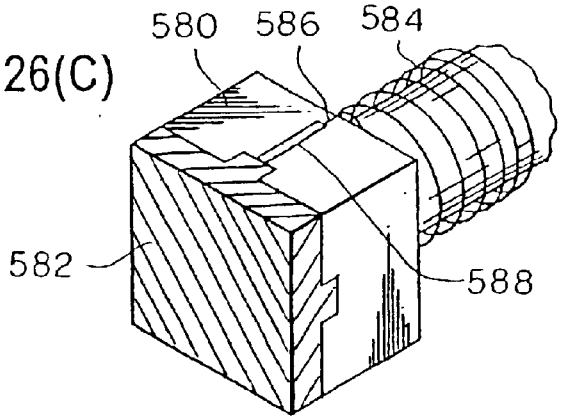
Figure 27A:
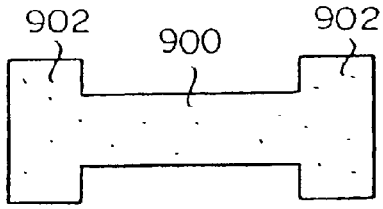
FIG. 27 shows a major part of a conventional method of producing a wire wound electronic part in sections.
Figure 27D:
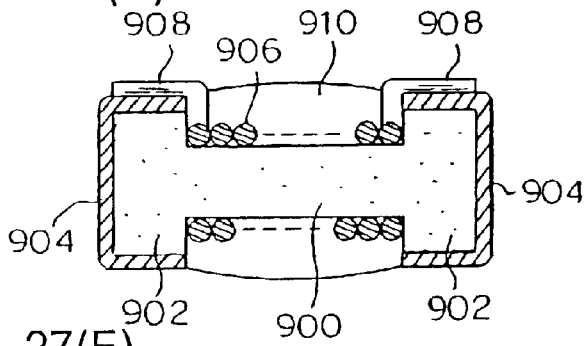
Figure 27B:
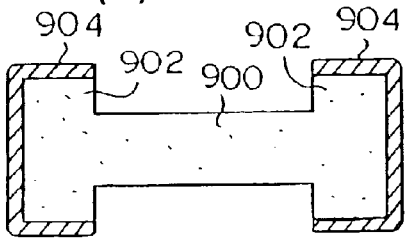
Figure 27E:
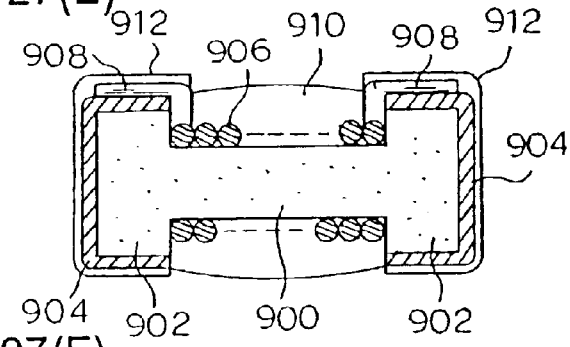
Figure 27C:
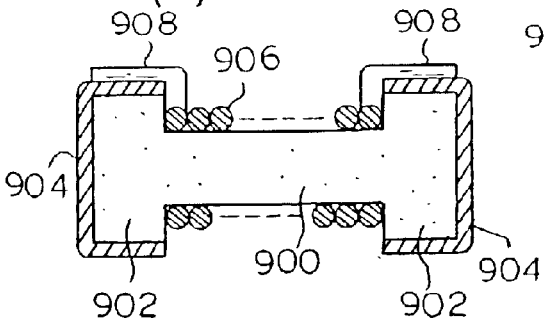
Figure 27F:
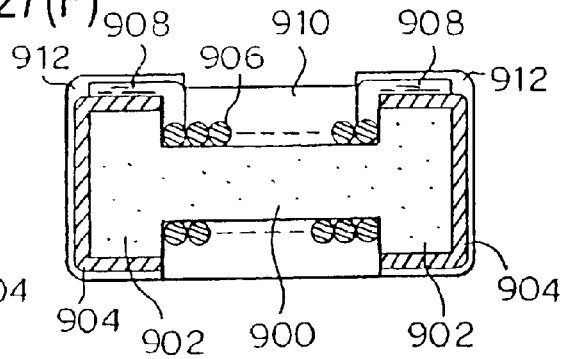

FIG. 26, (A), shows still another embodiment of the present invention so configured as to reduce the height of an electronic part. FIG. 26, (B) is a section along line #5—#5 of FIG. 26, (A). As shown, a bobbin has a core 572 and flanges 570 formed at both ends of the core 572. Each flange 570 is oblong, and the core 572 has an oval cross-section. Each flange 570 is formed with grooves 574 for receiving the conductor of a coil (not shown) in its sides. The longer sides of the flanges 570 are laid on a circuit board (not shown) so as to reduce the height of the electronic part. If desired, the shorter sides of the flanges 570 may be laid on the circuit board in order to reduce the area which the electronic part occupies. In this manner, a single electronic part is selectively usable for an application requiring a low height or an application requiring a small area. In addition, the core 572 having an oval cross-section guarantees a core area.

FIG. 26, (C), shows a further alternative embodiment of the present invention. As shown, a fuse 588 intervenes between an electrode 582 formed on a flange 580 and a conductor 586 protruding from a coil 584. In this embodiment, the electrode 582 is implemented by a thick film, so that the fuse 588 can exhibits its function sufficiently. The circuitry is protected if the fuse 588 is so designed as to blow when a current greater than a preselected current flows. Because an independent fuse is not necessary, this embodiment contributes to a small size, light weight configuration. If desired, the fuse 588 may be replaced with a resistor, capacitor or similar circuit element. From the mounting standpoint, grooves or similar recesses should preferably be formed in the flanges 580, so that the circuit element can be formed in any one of the grooves.

In any one of the embodiments shown and described, the bobbin having the flanges at its ends may be formed by baking, e.g., ferrite or alumina. The electrodes formed on the flanges each consists of a thin film or a thick film of, e.g., Ag, Ag—Pd, Ag—Pt or Cu having a thickness of 1 $\mu$m to 60 $\mu$m, and a 1 $\mu$m to 10 $\mu$m thick layer of, e.g., Ni, Sn or Sn—Pb formed on the above film by plating. For example, the bobbin is about 1.6 mm long, about 0.8 mm wide, and about 0.8 mm high. The core positioned at the center of the bobbin has a diameter of 0.2 mm to 0.7 mm while the flanges each has a width of 0.2 mm to 0.5 mm.

As stated above, the above embodiments has various unprecedented advantages, as enumerated below.

(1) An electronic part includes a coating having a flat surface and formed on a coil. The part can therefore be easily and surely sucked by the suction of an automatic mounting machine when it is to be transferred to a printed circuit board.

(2) Because the entire part is rectangular, it does not roll on a printed circuit board and is therefore easy to mount. In this respect, this part is advantageous over a drum-like bobbin having circular flanges.

(3) A block for forming a bobbin is formed with recesses or projections for centering. The block can therefore be machined with accuracy while facilitating machining work.

(4) Electrodes are formed by being shaved and therefore highly accurate in configuration.

(5) Caps are fitted on opposite ends of the above block, so that the part is desirably adaptive to various kinds of configurations.

(6) A paint is forced into the coil so as to enhance insulation.

(7) A core included in the bobbin has a rough surface, preventing the turns of the coil from being dislocated.

(8) Each flange and the core merge into each other via a curved portion, achieving improved strength.

(9) The number of steps for production is reduced. This enhances productivity and allows wire wound electronic parts each having a particular characteristic to be efficiently produced.

(10) Opposite ends of a conductor protruding from the coil are connected to electrodes at positions deviated from each other with respect to the longitudinal direction of the bobbin, so that L and Q can be adjusted, as desired.

(11) A protective coating is provided in order to obviate breakage and other troubles. This successfully improves quality and productivity.

(12) Irregularities are formed on at least one of the surfaces of the conductor and electrodes contacting each other, enhancing rigid bond between the conductor and the electrodes. Grooves are formed in the flanges of the bobbin in order to allow the conductor and electrodes to be bonded over a broader area. This additionally enhances rigid bond and provides the flanges with flat surfaces.

(13) When the electrodes are implemented by a paste, the content of a binder is selected such that it is high in the portions adjoining the flanges and low in the portions adjoining the conductor of the coil. Therefore, the bonding strength is increased between the flanges and the electrodes and between the electrodes and the conductor.

(14) The grooves formed in the flanges are tapered toward the outside. Therefore, the conductor received in the grooves bite into the walls of the grooves, increasing the bonding strength. This prevents the conductor from coming off and provides the flanges with flat surfaces.

(15) The conductor of the coil has its opposite ends inserted in through holes formed in the flanges. This prevents the conductor from coming off and allows the sides of each flange to remain flat.

(16) The ends of the conductor received in the grooves of the flanges each is positioned slightly short of the end of the groove or turned round to the end face of the flange over the end of the groove. The conductor is therefore surely prevented from coming off at the time of plating or mounting.

(17) A coating configured to bulge out from the electrodes is trimmed to have a preselected shape. The coating can therefore be accurately provided with flat surfaces desirable for mounting. Even a desired gap can be formed with accuracy, if desired.

(18) The coating is provided with a rough surface for reducing static electricity and dislocation, promoting desirable mounting.

(19) Grooves are formed in the sides of electrodes and allow the electrodes to be rigidly bonded to a circuit board by a small amount of solder or conductive paste.

(20) The flanges each has a rectangular configuration having an oblong end face. This reduces the height of the part or reduces the area which the part occupies.

(21) A circuit element is formed between the end of conductor of the coil and the electrode. This reduces the number of parts of and thereby improves efficient mounting.

Various modifications will become possible for those skilled in the art after receiving the teachings of the present disclosure without departing from the scope thereof.

(1) The bobbin has been shown and described as having a cylindrical core and rectangular flanges. Alternatively, the core may be provided with a rectangular section. For example, the present invention is similarly applicable to a vertical wire wound electronic part having a flange on only one end of a core. The grooves formed in the sides of the flanges are not essential. While a single groove may be formed in each flange, it should preferably be formed in each side of each flange from the mounting and characteristic adjustment standpoint. The materials for forming the various sections are open to choice.

(2) Any of the foregoing embodiments may be combined.

(3) While the embodiments have concentrated mainly on an inductor, they are similarly applicable to a common mode choke coil, transformer, beads array or similar wire wound electronic component.

(4) In the illustrative embodiments, the electrodes are formed by use of a silver paste. Alternatively, the electrodes may be formed by plating, sputtering, vapor deposition or similar technology. Further, the silver paste may be replaced with Cu, Ni, Ni—Cr or similar paste or even with a conductive resin.

What is claimed is:

1. A wire wounded electronic component comprising:

a bobbin comprising a core and a pair of flanges, each being formed at respective ends of said core;

a pair of external electrodes, each being formed on an end and sides of said pair of flanges, respectively;

a coil including a conductor wound around said core; and a coating formed on said coil and having a flat surface, wherein said coil has end portions, each being connected to the respective said pair of external electrodes and having one side flattened, the flattened one side situated opposite to a side adjacent one of said external electrodes.

2. The electronic component as claimed in claim 1, wherein grooves are respectively formed in sides of said flanges at positions deviated from each other with respect to a direction perpendicular to a lengthwise direction of said bobbin for connecting opposite ends of said conductor.

3. The electronic component as claimed in claim 1, wherein irregularities are formed on at least one of a surface of said conductor and surfaces of said external electrodes contacting each other.

4. The electronic component as claimed in claim 1, wherein said external electrodes are formed of a conductive paste, said conductive paste having a content of a binder thereof adjusted such that said content is high in the vicinity of said flanges, but low in the vicinity of said conductor.

5. The electronic component as claimed in claim 1, wherein said external electrodes each comprises a layer capable of closely contacting the respective flange and a layer capable of rigidly bonding to said conductor.

6. The electronic component as claimed in claim 1, wherein through holes are respectively formed in said flanges, said conductor having opposite ends thereof respectively inserted in said through holes and bonded to said external electrodes.

7. The electronic component as claimed in claim 1, wherein fine irregularities are formed on the surface of said coating.

8. The electronic component as claimed in claim 1, wherein said core has an oval cross-section perpendicular to a longitudinal direction of said bobbin while said flanges each has an oblong cross-section perpendicular to the longitudinal direction.

9. The electronic component as claimed in claim 1, wherein a circuit element is formed between any one of opposite ends of said conductor and an associated one of said external electrodes.

* * * * *